US011808145B2

(12) United States Patent
Fripp et al.

(10) Patent No.: US 11,808,145 B2
(45) Date of Patent: Nov. 7, 2023

(54) DOWNHOLE TELEMETRY DURING FLUID INJECTION OPERATIONS

(71) Applicant: Halliburton Energy Services, Inc., Houston, TX (US)

(72) Inventors: Michael Linley Fripp, Singapore (SG); Sean Christopher Canning, The Colony, TX (US); Daniel Keith Moeller, Lantana, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 75 days.

(21) Appl. No.: 17/452,982

(22) Filed: Oct. 29, 2021

(65) Prior Publication Data

US 2023/0132593 A1 May 4, 2023

(51) Int. Cl.

| | |
|---|---|
| ***E21B 47/24*** | (2012.01) |
| ***E21B 43/26*** | (2006.01) |
| ***E21B 34/14*** | (2006.01) |
| ***G10K 7/06*** | (2006.01) |

(52) U.S. Cl.

CPC ..... *E21B 47/24* (2020.05); *E21B 34/142* (2020.05); *E21B 43/261* (2013.01); *G10K 7/06* (2013.01); *E21B 43/2607* (2020.05)

(58) Field of Classification Search

CPC ..... E21B 33/16; E21B 33/12; E21B 43/261; E21B 47/12; E21B 47/14; E21B 47/18; E21B 47/24

See application file for complete search history.

(56) References Cited

U.S. PATENT DOCUMENTS 3,602,311 A 8/1971 Whitsitt
3,654,991 A * 4/1972 Harnsberger ..... E21B 43/261 166/281
5,477,923 A 12/1995 Jordan, Jr. et al.
(Continued)

FOREIGN PATENT DOCUMENTS

WO 2016053324 A1 7/2016
WO 2019156668 8/2019

OTHER PUBLICATIONS

Di, et al., "The Simulation of Fluid Dynamics Inside the Continuous Wave Mud Pulse Generator with Four-hole Rotary Valve", Atlantis Press, Advances in Engineering Research (AER), vol. 105, 3rd Annual International Conference on Mechanics and Mechanical Engineering (MME 2016), 2017, pp. 30-42.
(Continued)

*Primary Examiner* — Blake Michener
*Assistant Examiner* — Yanick A Akaragwe
(74) *Attorney, Agent, or Firm* — DELIZIO, PEACOCK, LEWIN & GUERRA

(57) ABSTRACT

A fluid signal generator configured to produce fluid pulses in a fluid column of a wellbore are described. The fluid pulses represent data and/or other information to be transmitted from a downhole device, such as a fluid plug apparatus located within the borehole of the wellbore, to one or more other devices located away from the downhole device, including devices located above a surface of the wellbore. The fluid plug may be configured to provide a fluid seal between a first portion of the wellbore and a second portion of the wellbore prior to and during a fluid treatment procedure being performed on the wellbore.

20 Claims, 13 Drawing Sheets

(56) References Cited

U.S. PATENT DOCUMENTS

| | | | | |
|---|---|---|---|---|
| 5,636,178 | A | 6/1997 | Ritter | |
| 7,066,106 | B2 | 6/2006 | Giebeler | |
| 9,482,069 | B2 | 11/2016 | Powers | |
| 10,125,568 | B2 | 11/2018 | Fripp et al. | |
| 10,125,573 | B2 | 11/2018 | Flores Perez et al. | |
| 10,352,121 | B2 | 7/2019 | Wise et al. | |
| 2010/0006292 | A1 | 1/2010 | Boles et al. | |
| 2013/0118739 | A1* | 5/2013 | Collins | E21B 43/26 166/279 |
| 2015/0075867 | A1 | 3/2015 | Eddison et al. | |
| 2016/0230533 | A1* | 8/2016 | Steele | E21B 47/007 |
| 2017/0009574 | A1* | 1/2017 | Murphree | E21B 47/20 |
| 2017/0130557 | A1* | 5/2017 | Pratt | F16K 31/082 |
| 2017/0328199 | A1* | 11/2017 | Marsh | F04B 51/00 |
| 2018/0223634 | A1* | 8/2018 | Holtz | E21B 43/26 |
| 2021/0115788 | A1* | 4/2021 | Teuchgraber | E21B 33/12 |
| 2021/0277743 | A1 | 9/2021 | Schultz et al. | |
| 2022/0372870 | A1* | 11/2022 | Hough | E21B 47/18 |

OTHER PUBLICATIONS

Su, et al., "Strategies in High-Data-Rate MWD Mud Pulse Telemetry", J. Sustainable Energy Eng., vol. 2, No. 3, DOI: 10.7569/JSEE.2014.629515, Dec. 2014, pp. 269-319.

"PCT Application No. PCT/US2021/072143, International Search Report and Written Opinion", dated Jul. 18, 2022, 15 pages.

* cited by examiner

DOWNHOLE TELEMETRY DURING FLUID INJECTION OPERATIONS

TECHNICAL FIELD

The disclosure generally relates to the field of downhole fluid injection operations and to well system telemetry.

BACKGROUND

Real-time feedback of operational properties, such as fluid pressure during hydraulic fracturing, is important for optimizing the fracturing process. Hydraulic fracturing operations entail applying high level fluid pressures within a cased or uncased wellbore conduit and into perforations through the wellbore wall into a formation. The turbulent operating environment and resultant acoustic interference limits practicable wireless telemetry options. The downhole noise may render the signal strength of traditional structural-acoustic telemetry, such as via electro-acoustic transducers, insufficient. Economical wellbore construction may preclude the use of electromagnetic telemetry equipment, such as insulated gaps, through different wellbore stages.

BRIEF DESCRIPTION OF THE DRAWINGS

Embodiments of the disclosure may be better understood by referencing the accompanying drawings.

DESCRIPTION OF EMBODIMENTS

Figure 1:
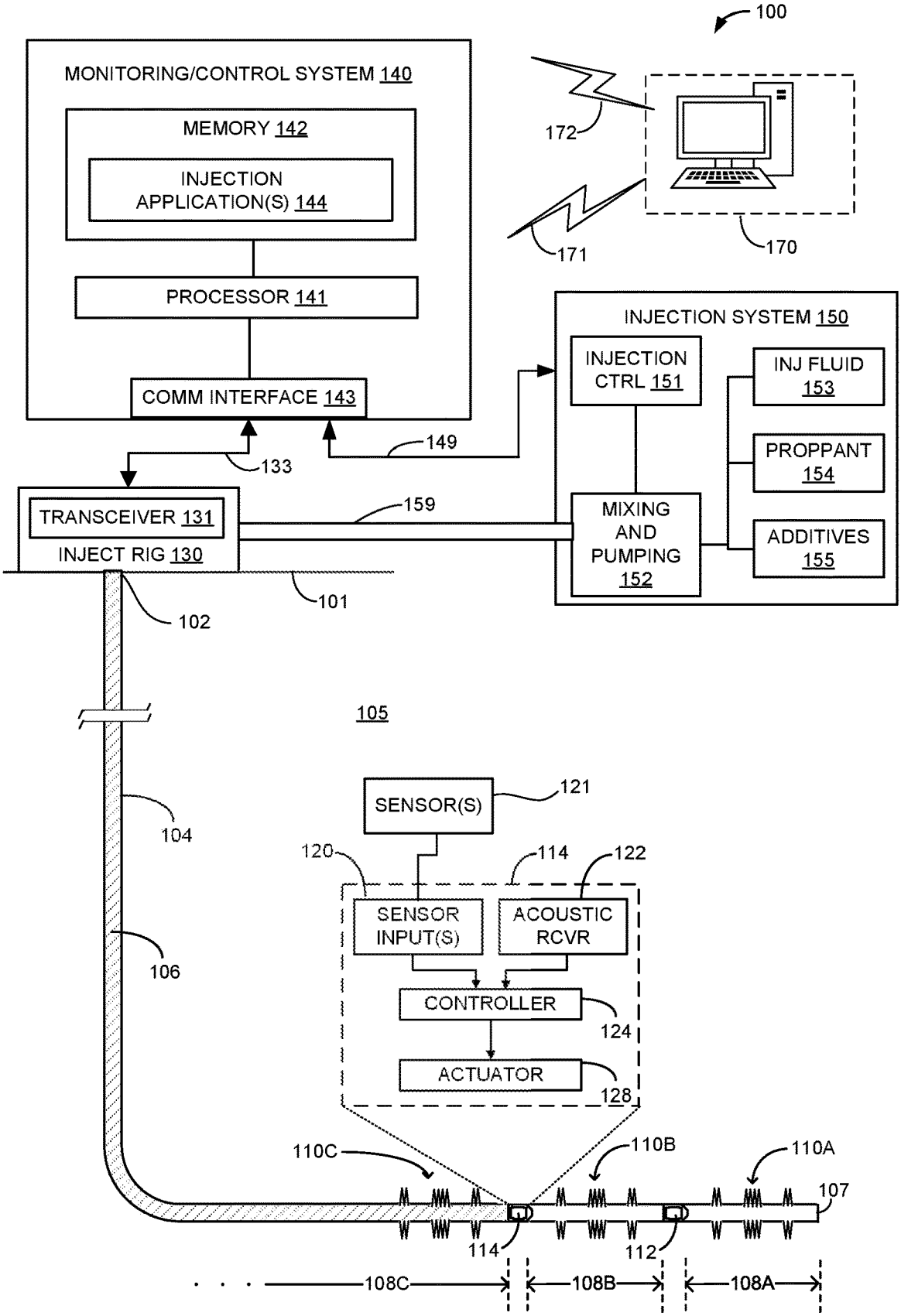
FIG. 1 is a high-level block diagram depicting a well system configured for hydraulic fracturing and in which fluid pulse telemetry may be implemented, in accordance with various embodiments.

The description that follows includes example systems, methods, techniques, and program flows that embody embodiments of the disclosure. However, it is understood that this disclosure may be practiced without these specific details. In other instances, well-known instruction instances, protocols, structures and techniques have not been shown in detail in order not to obfuscate the description. The term "uphole" in examples used this disclosure refers to the general direction relative to the surface or wellhead of a borehole, wherein a uphole direction is a direction within the borehole that leads to the surface or the wellhead of the wellbore. The use of the term "uphole location" may be used to refer to a position along the axis of the borehole that is closer to the surface or the wellhead of the borehole compared to another location along the borehole. The term "downhole" in examples used this disclosure refers to the general direction relative to a terminus or end of a borehole, wherein a downhole direction is a direction within the borehole that leads to the terminus or end of the borehole. The use of the term "downhole location" may be used to refer to a position along the axis of the borehole that is closer to the terminus or end of the borehole compared to another location along the borehole.

Overview

Disclosed embodiments include devices, components, systems, and methods for providing communications across well system components during wellbore fluid injection operations using fluid-acoustic wireless telemetry. Telemetry system utilized to provide communications, such as data transmissions, between devices located within a wellbore and/or between devices located within a wellbore and devices outside the wellbore may include wired and/or wireless systems. Versions of structural-acoustic wireless telemetry system send the wireless signals utilized for communications through vibrations in the steel tubing. Versions of fluid-acoustic wireless telemetry send the wireless signal that are utilized for communication through vibrations in a fluid, such as a column of fluid being utilized to perform a fluid treatment process, such as a fracturing process, on a wellbore.

Disclosed embodiments may include devices, components, systems, and methods for controlling aspects of fluid injection operations such as setting and modifying injection fluid flow rate and injection fluid pressure using well system telemetry that leverages aspects of high-pressure downhole fluid injection operations such as hydraulic fracturing injection and gravel packing operations. In some embodiments, a well system configured to implement fluid injection operations may include a fluid conduit within a wellbore and a system of pumps that that apply dynamically controllable pressure within the wellbore to generate a pressurized fluid column within the wellbore, which is provided and maintained within the wellbore for the purpose of fracturing the formation at some locations or locations surrounding the wellbore. In various embodiments, the fracturing procedure involves providing an injection fluid to the wellbore in a single flow path, the single flow path having a first end at the surface and ending at the toe of the wellbore, the injection fluid provided from the surface and in a direction downhole without the need for a return path to the surface for the injection fluid. In various embodiments, the pressurized fluid column is a solids-free stimulation fluid provided so that the stimulation fluid can flow into the formation without fracturing.

An injection pressurization plug is installed within the wellbore below the pressurized fluid column and above a previously treated or otherwise non-pressurized portion of the wellbore. The injection pressurization plug is configured to block flow of the pressurized fluid column and may include a plug body and an outer pressure seal disposed on an outer cylindrical surface of the plug body. The plug body with the outer pressure seal are configured to provide a contact pressure barrier with an inner surface of a wellbore to block flow of the pressurized fluid column within the wellbore. A fluid signal generator may be disposed within the plug body and configured to transmit fluid signals through the pressurized fluid column. The fluid signals may be generated by controllably opening and closing a fluid flow channel within the pressurization plug, the fluid flow channel extending from the pressurized fluid column to an unpressurized side of the plug. In some embodiments, the plug body may comprise a complete plug apparatus or part of a plug apparatus such as a frac ball.

A well system configured to implement fluid injection operations may also include an acoustic receiver configured to receive and decode the fluid signals. An injection controller may be communicably coupled to the acoustic receiver and may be configured to generate fluid injection control instructions based, at least in part, on the decoded fluid signals. The injection controller may comprise a flow rate controller communicatively coupled to a fluid injection system, said flow rate controller configured to determine at least one of injection flow rate of the fluid injection system and an injection fluid pressure of the fluid injection system based, at least in part, on the decoded fluid signals.

Example Illustrations

FIG. 1 is a block diagram depicting a well system 100 configured to implement fluid injection and treatment operations in accordance with various embodiments. Well system 100 includes sub-systems, devices, and components configured to implement multi-stage fluid injection operations, such as hydraulic fracturing operations or gravel packing operations, within a wellbore 104. In the embodiment depicted in FIG. 1, well system 100 includes an injection rig 130 positioned over or proximate to the wellhead 102 of the wellbore 104 at surface 101. Well system 100 further includes an injection system 150 configured to mix and provide to the injection rig 130 an injection fluid for use in the fracturing and/or fluid treatment operations to be performed on wellbore 104, and a monitoring/control system 140 to communicate with one or more downhole apparatus, and in various embodiments to provide control over the fluid injection operations being performed on wellbore 104, as further described below.

Wellbore 104 in the depicted embodiment of FIG. 1 comprises the cylindrical conduit as being a casing string. In some embodiments, wellbore 104 may comprise a conduit within a different type of wellbore treatment string, or may be an uncased, open borehole. In some embodiments, wellbore 104 may comprise coiled tubing that sits within a cased hole. Injection rig 130 includes components for configuring and controlling deployment of fluid injection components within wellbore 104. For example, injection rig 130 may be configured to deploy one or more plug apparatuses, such as plug apparatuses 112 and 114, sequentially at specified respective locations within wellbore 104. Plug apparatuses 112 and 114 may be positioned within wellbore 104 using pump-down operations, in which a given plug apparatus may be coupled to a wireline bottom hole assembly (not depicted) that includes a setting tool as well as the plug apparatus. In various embodiments, use of a slickline, jointed tubing, or coiled tubing may also be used for placing the plug apparatus at the desired location(s) along the wellbore. In alternative embodiments, the plug apparatus may be fixedly attached to the formation through the use of cement, slips, swellable packer, or a chemically reacting packer. For hydraulic fracturing operations, the bottom hole assembly that deploys the plug apparatuses may also include a perforating gun (not depicted). During a perforation phase of each hydraulic fracturing operation, the perforating gun is positioned at a desired location within the wellbore 104, and once located, fires a charge or multiple charges arranged to perforate the metallic casing, cement sheath, and/or proximate formation material at the desired location or locations along wellbore 104. The perforations within the resultant perforation cluster(s) result in small fractures in the rock, typically shale, proximate wellbore 104. In the depicted embodiment, three distinct sets of perforation clusters—110A, 110B, and 110C—correspond to one of three distinct hydraulic fracturing cycles in which perforation clusters 110A, 110B, and 110C may in some embodiments be generated sequentially, with cluster 110A generated furthest from the wellhead 102, cluster 110B generated closer to the wellhead 102 compared to cluster 110A, and wherein cluster 110C generated at a location along the borehole closest to the wellhead.

Injection rig 130 is configured to implement an injection phase, sometimes referred to as stimulation procedure for hydraulic fracturing, in which fluid is pumped at high pressure down the typically cased or otherwise lined wellbore 104 to form a fluid column 106 above the last (most uphole) blockage within wellbore 104. For example, the first fluid injection phase following creation of perforation cluster 110A, and prior to creation of clusters 110B and 110C and the setting of plug apparatuses 112 and 114, may include pumping some form of treatment fluid up to the end 107 of wellbore 104. The fluid path is block by the end 107 of wellbore 104, resulting in a high-pressure fluid column that penetrates through the holes within perforation cluster 110A and into formation within downhole strata 105. The fluid penetration results in fracturing of formation rock material. Following an initial hydraulic fracturing operation at or near the end 107 of the wellbore, subsequent fracturing operations are implemented by setting plugs, such as plug apparatus 112 and 114, to form the wellbore blockages configured to withstand sufficient fluid pressure for injection fracturing for each subsequent perforation cluster while preventing perforation cluster 110A from being exposed to the fluid pressure applied in these subsequent fracturing operations. Typical fluid pressures for hydraulic fracturing injection treatments may be in a range from 1,000 to 15,00 pounds per square inch (PSI). In various embodiments, the pressure of the hydraulic fracturing fluid utilized in a fracturing procedure exceeds a pressure needed to fracture the formation by at least 100 PSI.

For a hydraulic fracturing application, FIG. 1 depicts a configuration in which the zones covered by perforation clusters 110A and 110B have already been treated with injection fluid, so that a second plug, plug apparatus 114, has been set for a third injection treatment. For example, as described above a first fluid injection operation may be performed on borehole 104, wherein neither plug apparatus 112 nor plug apparatus 114 having been set within the borehole. During this first fluid treatment operation, perforations illustratively represented by perforation clusters 110A within zone 108A of the borehole may have been already provided by a perforation operation. Perforations illustratively represented by perforation clusters 110B and/or 110C may or may not have already been provided before the first fluid treatment operation is performed. Upon completion of the first fluid treatment operation, plug apparatus 112 is set in place in the borehole between zones 108A and 108B, and activated to seal off the portion of the borehole represented by zone 108A. A second fluid treatment may then be performed on the borehole, wherein only perforation provided in perforation cluster 110B in zone 108B of the borehole, (and if present, perforations in perforation cluster 110C and zone 108C), are exposed to the fluid pressures and treatment fluid provided as part of the second fluid treatment operations. Following completion of the second fluid treatment operation, a third treatment operation may be initiated.

The illustration of well system 100 depicts a state of the wellbore system that may exist at the time of initiation of and throughout the performance of the third fluid treatment operation. For the third injection treatment, injection rig 130 pumps plug apparatus 114 to a position within the borehole 104 between perforation cluster 110B and 110C. Once plug apparatus 114 is in position, the plug is activated to lock the plug in place and provide a pressure seal against any pressurized fluid column 106 provided uphole of the plug apparatus within the borehole and proximate to the uphole side of the plug apparatus. Injection fluid is provided to form fluid column 106 may through injection rig 130 coupled to an injection system 150. Because of the location of plug apparatus 114 below (downhole) and the position of perforation clusters 110C located in zone 108C, the pressurized fluid provided in fluid column 106 is in contact with and is able to apply fluid pressure to the strata 105 in the area proximate the perforation clusters 110C. As such, a fracturing operation may be performed by well system 100 in the area of perforation clusters 110C when configured with plug apparatus 114 in place as illustrated in FIG. 1.

Embodiments of well system 100 as illustrated in FIG. 1 includes a monitoring/control system 140, an injection system 150, and a user interface 170. Monitoring/control system 140 may operate above surface 101, and within or proximate to injection rig 130 in various embodiments. Monitoring/control system 140 comprises, in part, one or more computer processors 141, and one or more computer memory devices 142, which together are configured to store and execute program instructions for monitoring and controlling the overall fluid treatment procedures that are to be or that are being performed on a wellbore, such as wellbore 104. In various embodiments, memory 142 of the monitoring/control system 140 includes one or more programs, instructions, parameters, thresholds values, and/or other data, in the form of one or more injection applications 144, that may be utilized by the one or more processors 144 to execute instructions designed to monitor and control the fluid treatment procedure(s) to be or that are being performed on wellbore 104. In various embodiments, monitoring/control system 140 may comprise some combination of, or in some embodiments all of the components illustrated and described below with respect to FIG. 9 and computer system 900.

Monitoring/control system 140 is communicatively coupled to injection system 150 via a communication link, such as communication link 149. Communication link 149 is not limited to any particular type of communication link, and may include any type or combination of devices, such as bus systems, electrical cabling, and/or wireless communication devices that allow for electronic communication to occur between the monitoring/control system 140 and one or more devices of the injection system 150, including but not limited communications with the injection controller 151 included in the injection system 150. In various embodiments, monitoring/control system 140 is configured to execute programs, for example a program comprising a set of parameters for dictating a particular fluid treatment process, which includes generating instructions that are communicated to the injection system 150 in order to control the operation of the injection system for providing treatment fluid(s) to the injection rig 130 based on the desired fluid treatment process to be performed on the wellbore 104.

In various embodiments, based on instructions received from the monitoring/control system 140, injection system 150 may be configured to provide a prescribed type or mixture of fluid, for example through fluid conduit 159, to the injection rig 130 for injection into wellbore 104. The instructions provided to injection system 150 may include instruction regarding various parameters related to the fluid(s) to be injected into the wellbore, the pressure(s) and/or pressure profiles hat are to be used to inject the fluid during the fluid treatment process, and/or instructions related to the flow rate(s) at which the fluid being used during the fluid treatment process are to be provided to the injection rig 130. In various embodiments, monitoring/control system 140 may provide instructions to injection system 150 related to operation of specific devices, such as the operation of valves and/or related to the use of pump(s), such as the number of pumps be utilized at any given stage of a particular fluid treatment operation. In various embodiments, one or more components included within injection system 150, such as injection controller 151, may receive instructions from monitor/control system 140, and based on the received instructions, may make further determinations related to the operation of the devices, such as the valves and/or pumps, which are included in injection system 150 and that are being utilized to carry out a fluid treatment operation. In various embodiments, injection system 150 may communicate information back to monitoring/control system 140, such as a confirmation of receipt of instructions provided from the monitoring/control system, information related to the status of the mixing and/or fluid operations being performed by the injection system 150, and/or any error or warning messages that might relate to issues, such as failed components, which might be detected by or within the injection system 150.

Injection system 150 includes various components and devices configured to provide a desired mixture of fluid components to the injection rig 130 for injection into wellbore 104 as part of a fracturing or fluid stimulation procedure. As illustrated in FIG. 1, injection system 150 includes sources for a plurality of fluid components, such as injection fluid 153, proppant 154, and additives 155. Injection fluid 153 may comprise a fluid, such as water, brine, carbon dioxide, or nitrogen, used to provide the bulk of the fluid that is injected into wellbore 104 for a fracturing process. Proppant 154 may comprise material such as sand or ceramic beads, used in combination with the injection fluid to increase the permeability of the formation. Additives 155 are not limited to any particular type of additive, and may include such materials as gelling agents, friction reducers, bactericides, permeability modifiers, foaming agent, and corrosion inhibitors. Additives may be added to the injection fluid 153 in order to alter and/or control a particular property, such as a chemical or physical property, of the injection fluid prior to the injection fluid being utilized in a fracturing or other treatment operation being performed on wellbore 104. In various embodiments, the fluid produced/provided by the injection system is a solids-free fluid, which means it has a turbidity measurement of less than 1000 Formazin Nephelometric Units (FNU). In various embodiments, the fluid produced/provided by the injection system 150 may have a very low in drilling mud content or may be drilling mud free.

Embodiments of injection system 150 includes a mixing and pumping unit (unit) 152. Unit 152 may be in fluid communication with each of the sources of injection fluid 153, proppant 154, and additives 155. Unit 152 includes valving, manifolds, flow control valves, or other devices that allows the unit to controllable combine, in a desired proportion, the mixture of injection fluid, proppant, and/or additives to formulate a desired blend of material to be provided to injection rig 130 for injection into wellbore 104 as part of a fracturing or stimulation treatment being performed on wellbore 104. Unit 152 includes one or more pumps that may draw fluid and/or materials from any the sources of injection fluid 153, proppant 154, and/or additives 155. Unit 152 may include one or more pumps configured to provide the fluid pressure needed to cause the treatment fluid mixed at unit 152 to flow to the injection rig 130, for example through fluid conduit 159. In various embodiments, unit 152 also includes one or more pumps configured to provide the required level of fluid pressure, for example through fluid conduits coupling fluid conduit 159 to the wellbore 104 through injection rig 130, that is needed to pressurize fluid column 106 within the wellbore to a desired pressure level as part of a fracturing or stimulation treatment operations being performed on the wellbore. In various embodiments, unit 152 may also be in fluid communication with a waste reservoir 156, such as a waste tank or waste pit, wherein unit 152 is configured to pump fluid from wellbore 104 back through fluid conduit 159, or an alternative fluid conduit (not shown in FIG. 1), and into waste reservoir 156, for example to relieve fluid pressure on the fluid column 106 following completion of the a fracturing or stimulation treatment procedure.

Embodiments of injection system 150 may or may not include an injection controller 151. In embodiments that include the injection controller 151, the injection controller may be a computer processing system, such as or similar to computer system 900 as illustrated and described below with respect to FIG. 9. Referring again to FIG. 1, injection controller 151 when provided may be coupled through communication link 149 with monitoring/control system 140. In various embodiments, injection controller 151 is configured to provide control signals to unit 152 to control the operation of the valves, manifolds, and/or pumps included in unit 152 in order to control the mixing process of the fluid being prepared for injection into wellbore 104, and/or to control the operator of the one or more pumps included in unit 152 in order to control the pressure and/or the flow rate of the treatment fluid being provided to injection rig 130 as part of a fracturing or stimulation treatment being performed on the wellbore 104. In various embodiments, injection controller 151 receives control signals from the monitoring/control system 140 based on outputs provided by injection application 144, which are configured to be used by injection controller 151 to operate unit 152 in order to provide the desire fluid mixture and/or the desired fluid pressures and flow rates as part of a planned fluid injection operation. In embodiments that do not include injection controller 151, one or more processors 141 of the monitoring/control system 140 may provide control signals, for example via communication link 149, that are configured to directly control the operations of the devices included in injection system 150, such as unit 152. In such embodiments, devices included in injection system 150 may be configured to provide output signals, for example output signals from one or more sensors, hat are communicated to the monitoring/control system 140, for example via communication link 149. The monitoring/control system 140 may be configured to receive these output signals, and provide the desired control over the injection system 150 based at least in part on these output signals received from the injection system.

One or more of the plug apparatuses, such as plug apparatus 112 and/or 114, may be configured to communicate with one or more other devices within borehole 104 and/or one or more devices located above surface 101, such as injection rig 130 and/or monitoring/control system 140. In various embodiments, the plug apparatus 112 and/or 114 includes a fluid signal generator configured to produce fluid signals that are induced into the fluid column 106, and thus travel from the source of the fluid signals, for example the plug apparatus 114, through the pressurized fluid column 106 to one or more other devices. For example, injection rig 130 may include a transceiver 131 that may comprise a sensor, such as an acoustic sensor, which is configured to detect the fluid signal being transmitted through the fluid column 106. The transceiver 131 may, based on the detected fluid signals, generate an output signal, which corresponds to the data and/or any information included in the fluid signal, and communicate the output signal to monitoring/control system 140 via communication link 133. In various embodiments, monitoring/control system 140 includes a communication interface 143 that is configured to receive the signals sent from transceiver 131 over communication link 133. Communication link 133 is not limited to any particular type of communication link, and may include any type of bus, electrical cabling, and/or wireless communication devices configured to transmit signal between injection rig 130 and monitoring/control system 140.

In various embodiments, the fluid signals include data and/or other information generated and transmitted by the plug apparatus, such as plug apparatus 114, and may include real-time or near real-time data related to various parameters, such as fluid pressures, fluid temperature, fluid flow rates, rates of changes in these parameters, and/or chemical properties related sensor data gathered at or near the plug apparatus while the plug apparatus is located within the wellbore and while during a fluid treatment procedure being performed on the wellbore. In various embodiments, each of plug apparatuses 112 and 114 is configured to communicate downhole sensor information, such as measured injection pressures, temperatures, flow rates, and/or chemical property information to the monitoring/control system 140. Plug apparatuses 112 and 114 may communicate to monitoring/control system 140 via a two-stage communication link including a downhole-to-surface acoustic link through fluid column 106, and a surface communication link 133. In the depicted embodiment, the downhole-to-surface link comprises pressure signal transmitter components within plug apparatuses 112 and 114, a pressurized fluid column 106 within wellbore 104, and an acoustic receiver 131 within injection rig 130.

Monitoring/control system 140 may receive the data and/or other information provided by plug apparatus 112 and/or 114, and use the received data or other information to log and/or confirm that the fluid treatment process that is underway within the wellbore 104 is proceeding as desired and/or is operating within pre-prescribed limits for various parameters, fluid pressures, fluid temperature, fluid flow rates, rates of changes in these parameters, and/or chemical properties. In various embodiments, monitoring/control system 140 may, based on the data and/or other information received from the plug apparatus 114 and/or 112, determine that adjustments to the fluid treatment process that is underway within wellbore 104 needs to be adjusted, and based on such a determination, may generate and communication to injection system 150 one or more instructions to alter or otherwise modify some aspect of the fluid treatments process, such as the fluid pressure and/or the rate of injection of fluid being applied to the borehole, and/or instructions to modify the mixture, and thus the chemical composition of the fluid being applied as part of the fluid treatment process. In various embodiments, monitoring/control system 140, may not provide closed loop control of the fluid treatment process based on data received from the sensors of a downhole plug apparatus, but may for example utilize the data to update reservoir models. However, in other embodiments, monitoring/control system 140 may incorporate the data and other information received from the sensors of the downhole apparatus to perform feedback control, feedforward control, or process control functions for an ongoing fluid treatment process that is underway. In various embodiments processor 141 of the monitoring/control system 140 Amy include a control algorithm that combines the received data from the downhole sensor of the plug apparatus with previous received data into the control algorithm to calculate the parameters for the injection system 150.

In various embodiments, monitoring/control system 140 may terminate a fluid treatment process that is being performed on wellbore 104 based on the data and/or other information received by the monitoring/control system from one or more of plug apparatus 114 and 112. A termination of a fluid treatment process may be executed for example when a confirmation is made that the fluid treatment process has been successfully completed, based for example on one or more parameters such as fluid pressure, rate of changes in fluid pressures, fluid flow (acoustic noise), fluid temperatures, and/or chemical analysis of the fluids present in the proximity to the location of the plug apparatus positioned within the wellbore 104. In various embodiments, decisions about adjustments to and or termination of the fluid treatment process may be based on any such parameter measurements, a rate of change of any measured parameter(s) a comparison of one or more parameters between different section of the borehole and/or differences between different fluid treatment processed performed on the same wellbore or different wellbores. A termination of the fluid treatment process may also be executed for example based on a determination that there is a problem or issue with the fluid treatment process that merits halting continuation of the fluid treatment process.

As described above, injection rig 130 may include a transceiver 131. In various embodiments, transceiver 131 is configured to detect the fluid signals, such as variations in fluid pressure and/or fluid flow rates that were generated by plug apparatus 114 and transmitted through fluid column 106 as data. Transceiver 131 may be configured to translate these received fluid signals into another form, such as electronic signal, which are representative of the data provided in the fluid signals, and transmit the received data signals to a communication interface 143 of the monitoring/control system 140 via communication link 133. Communication link 149 is not limited to a particular type of communication link, and may in various example be a coaxial cable, a twisted pair cable, or any other type of electrical bus configured to transmit data signals from transceiver 131 to monitoring system 140. In various embodiments, processor 141 of monitoring system 140 is configured to receive that data signal provided by transceiver 131, and to process these data signals using injection application 144 to generate output control signals, which may then be passed along via communication link 149 to the injection system 150. The output control signals provided by monitoring system 140 to injection system 150 may include any signals and/or instructions that may be used by injection controller 151 to control the operation of unit 152 in order to control the mixing and the pressures and/or flow rates of the fluids being provided to injection rig 130 as part of a fluid injection or stimulation treatment operation being performed on wellbore 104. As such, well system 100 is configured to provide closed-loop control, in real time or near real-time, with respect to fluid injection operation(s) being performed on wellbore 104, and based in least in part of data gathered at or proximate to the fracturing zones being treated by the fluid injection operations.

In various embodiments, only the plug apparatus, such as plug apparatus 114 in FIG. 1, which is closest to the wellhead 102 and is therefore in direct contact with the fluid present in the fluid column 106 is operating to generated and provide fluid signals that are induced into the fluid column 106. In various embodiments, one or more additional plug apparatus, such as plug apparatus 112 in FIG. 1, that are downhole relative to the plug apparatus closest to the wellhead 102 may be is operated to produce fluid signals. In such embodiments, these fluid signals generated by the additional downhole plug apparatus may be detected by sensors of the uphole plug, and used to generate fluid signals that are induced into the fluid column 106 based on the data and/or other information revied from the one or more downhole plug apparatus.

Plug apparatus, such as plug apparatus 112 and 114, include various components that allow the plug apparatus to generate the fluid signals imposed onto the fluid column 106. As shown in FIG. 1, embodiments of plug apparatus 114 may include a sensor input 120 coupled to one or more sensors 121, and a controller 124, an actuator 128. Controller 124 may include one or more processors and additional computer components, such as the computer system illustrated and described with respect to FIG. 8 and computer system 800. The one or more sensors 121 may be configured to provide output signals related to one or more sensed parameters, such as fluid pressure, rate of changes in fluid pressures, fluid flow (acoustic noise), fluid temperatures, and/or chemical properties of the fluid or fluids present where the sensors are located within or proximate to the borehole were the plug apparatus 114 is located. The input signals provided by the sensors 121 may be received at sensor input 120 for further processing, and may then be utilized by controller 124 to generate data and other information. Controller 124 is further configured to control actuator 128 in order to impose the fluid signals onto the fluid column 106. The fluid signal may include data corresponding directly or derived from the output signals received form the one or more sensors 121, and/or additional information, such as check sum values, synchronization symbols, baud rate information, and any other types of information related to the data transmission being utilized by the fluid signals. As described above, the fluid signals produced by the plug apparatus 114 and imposed onto the fluid column 106 may be received at transceiver 131, and communicated to the monitoring/control system 140, wherein the monitoring/control system may then record, analyze and/or act upon the received data and other information.

In various embodiments, communication of data and/or other information may also originate from the monitoring/control system 140, and be transmitted, for example using transceiver 131, into fluid signals that are transmitted through fluid column 106 to plug apparatus 114. Plug apparatus 114 may include an acoustic receiver 122 configured to detect the fluid pulse signals transmitted downhole, and to generate input signals to the controller 124 based on the detected fluid pulse signals. In various embodiments, at last some portion of the acoustic receiver and/or the transmission path from acoustic receiver 122 to monitoring/control system 140 includes fiber optics and/or fiber optic cabling. Data and information transmitted to the plug apparatus 114 from the monitoring/control system 140 may include instructions as to what types of data the plug apparatus is to gather and transmit back to the monitoring/control system, when to make such transmissions, and/or other information related to the formatting of the data and/or other information to be transmitted by the plug apparatus. In various embodiments, acoustic receiver 122 is also configured to detect the fluid signals generated by the actuator 128 of the plug apparatus 114, and to provide a feedback signal to controller 124 based on the detected fluid pulse signals. These feedback signals may act as a check and/or confirmation that the actuator 128 is functioning properly to impose of the fluid column 106 the desired configuration of fluid pulses.

Figure 8:
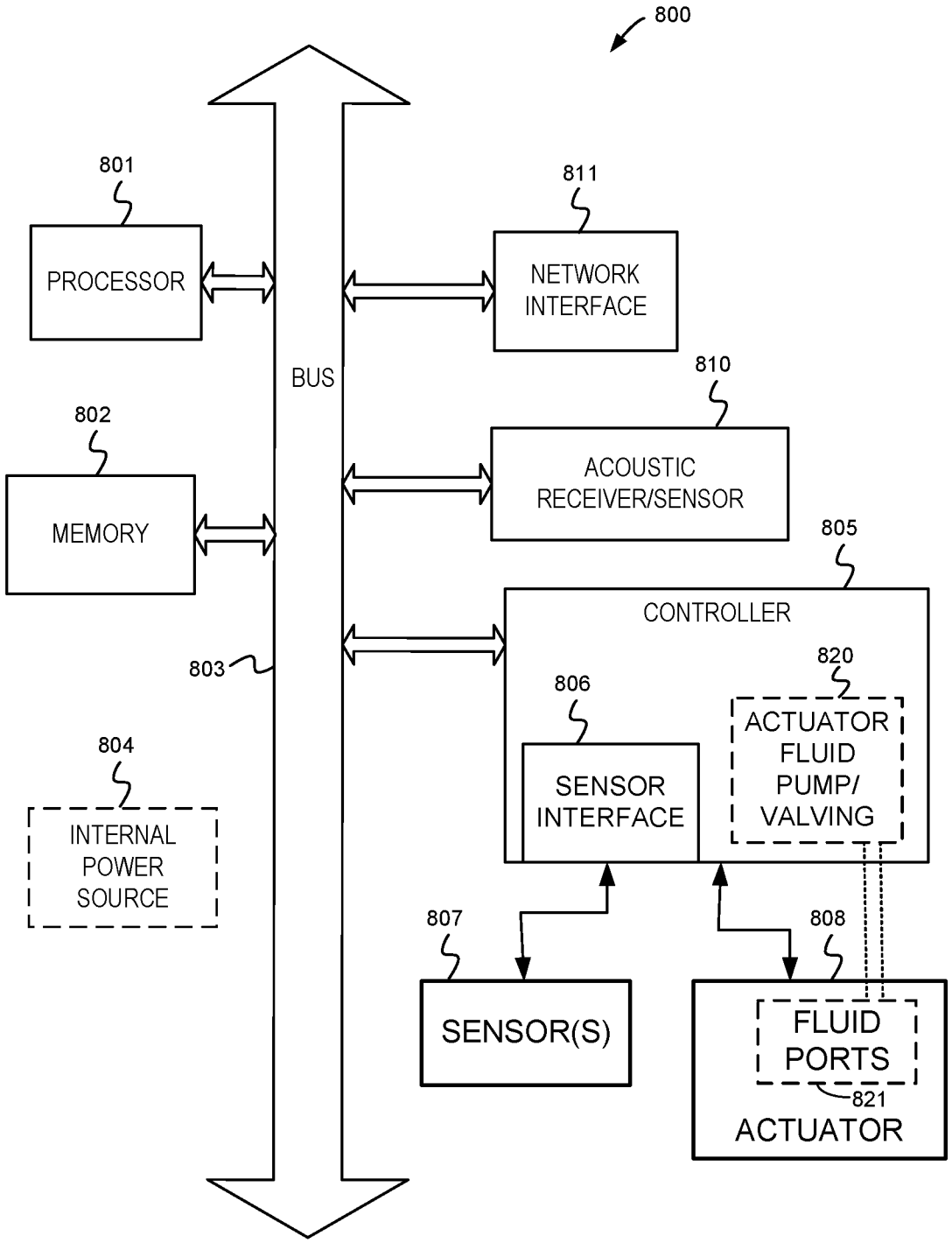
FIG. 8 illustrates a block diagram of an example computer control system that may be employed to practice the concepts, methods, and techniques disclosed herein, and variations thereof.
Figure 9:
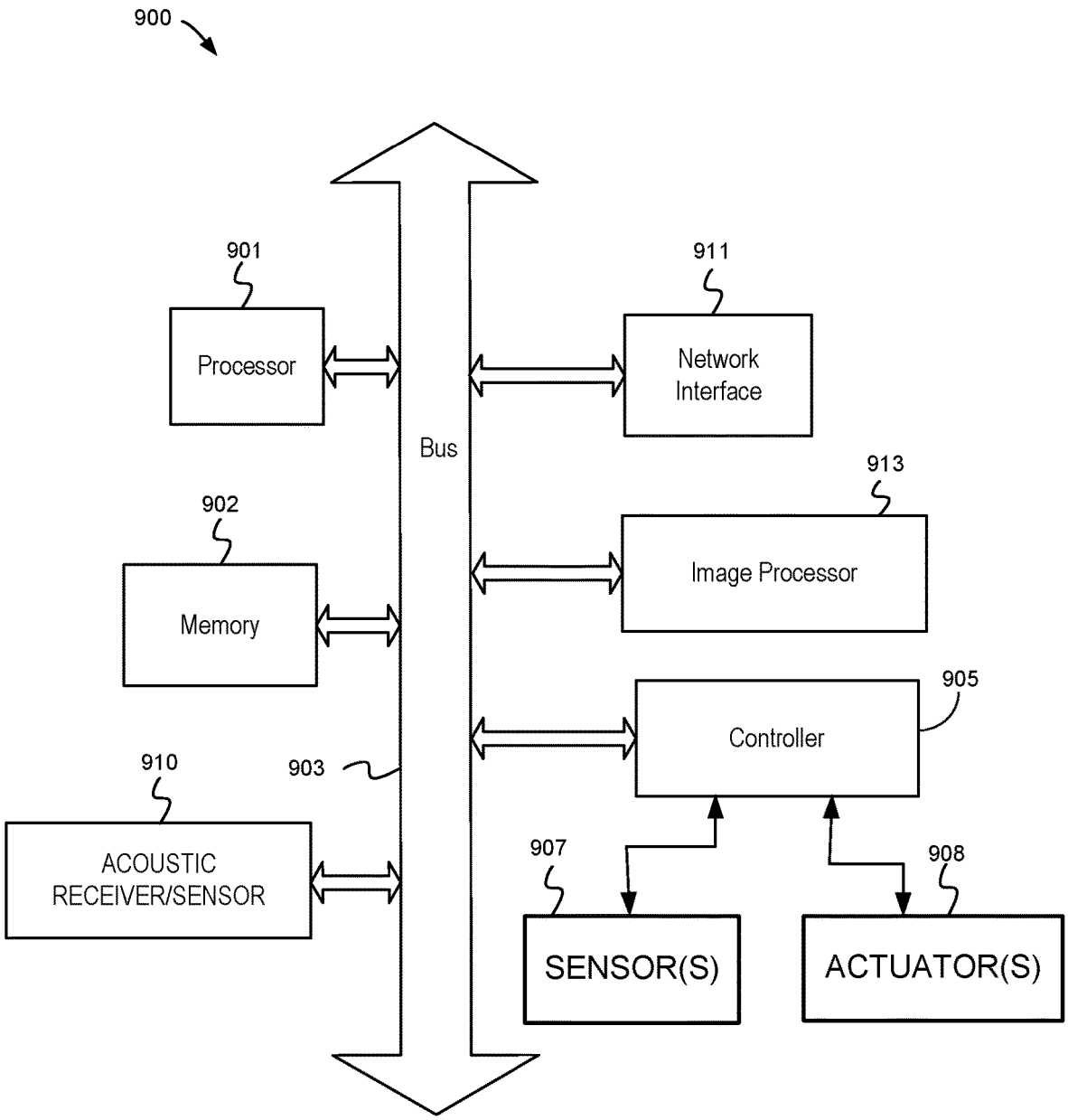
FIG. 9 illustrates a block diagram of an example computer control system that may be employed to practice the concepts, methods, and techniques disclosed herein, and variations thereof.

Embodiments of well system 100 may include a user interface device, as illustratively represented in FIG. 1 by user interface 170. User interface 170 may include a personal computer, a lap-top computer, or some other type of user interface device, such as a smart phone. In various embodiments, user interface 170 may include a computer system including a combination or all of the subcomponents as illustrated and described below with respect to FIG. 9 and computer system 900. In various embodiments, user interface 170 includes a display device, such as a monitor, which is configured to provide visual display of data and other information related to well system 100 and/or to a fluid treatment process being performed on or modeled for wellbore 104. Computer system may include one or more input devices, such as a keyboard, computer mouse, and/or a touch screen that allow a user, such as a technician or engineer, to provide inputs to user interface 170, which may include requests for information regarding the status of well system 100 and/or inputs that may be used to direct the fluid treatment procedures being or to be performed on wellbore 104. Connections between user interface 170 and other devices included in in well system 100 may be provided by wired and/or wireless communication connection(s), as illustratively represented by lightning bolt 171. Connections between user interface 170 and other devices not included in in well system 100 (not shown in FIG. 1), such as databases, servers, and/or other computer devices, may be provided by wired and/or wireless communication connection(s), as illustratively represented by lightning bolt 172. Various examples and additional details related to the features and functions that may be provided by embodiments of the plug apparatus are further illustrated and described with respect to FIGS. 2, 3, 4A-4B, 5A-5D, 6A-6D, 7, and 8. FIG. 9 illustrates a computer system 900 that may be included, in some form, in one or more devices located above surface 101, such as injection rig 130, monitoring/control system 140, and/or injection system 150.

Figure 1A:
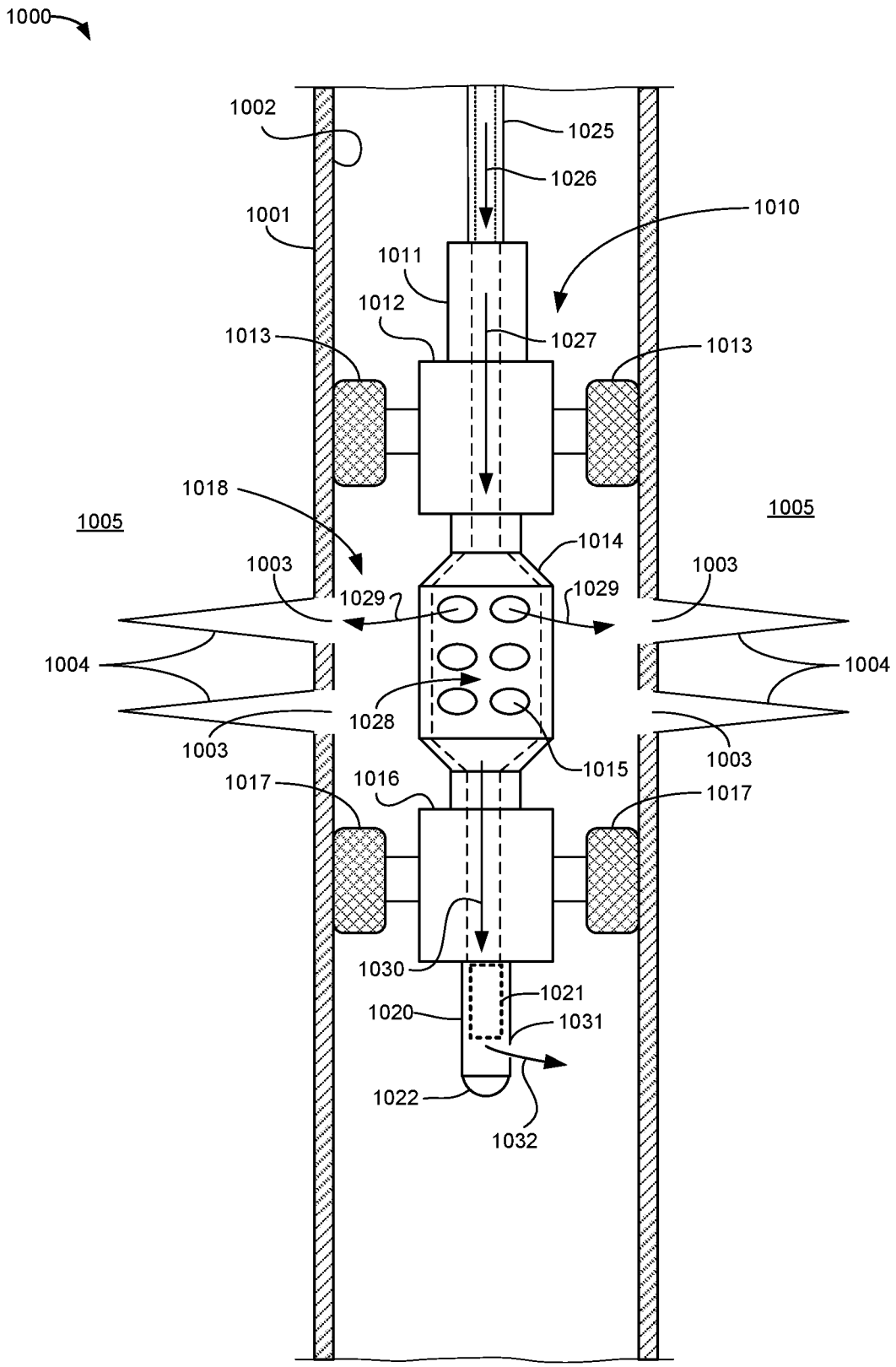
FIG. 1A is a cross-sectional diagram illustrating a wellbore system including a plug apparatus coupled to a coiled tubing, in accordance with various embodiments.

FIG. 1A is a cross-sectional diagram illustrating a wellbore system 1000 including plug apparatus 1010 coupled to a coiled tubing 1025, according to various embodiments. As illustrated in FIG. 1A, plug apparatus 1010 is positioned within a casing 1001 of a wellbore at a location proximate one or more perforations 1003 extending from within the casing to areas outside the case, including one or more fractures 1004 that may be formed in the formation material 1005 surrounding the casing. In various embodiments, plug apparatus 1010 may be an example of plug apparatus 112 and/or plug apparatus 114 as illustrated and described above with respect to FIG. 1.

Referring again to FIG. 1A, plug apparatus 1010 includes a top coupling 1011 that mechanically couples the plug apparatus to a length of coiled tubing 1025. Coiled tubing may extend from top coupling 1011 to a surface of the wellbore and beyond, wherein coiled tubing 1025 is configured to suspend and support the weight of the plug apparatus 1010 and any of the coiled tubing extending into the casing 1001, so that the plug apparatus may be lowered into and positioned at a location downhole within the casing. As shown in FIG. 1A, plug apparatus is positioned proximate to the one or more perforations 1003 provided in casing 1001. Plug apparatus 1010 further includes an upper packer 1012 mechanically coupled to the top coupling 1011 and positioned uphole from perforations 1003, and a lower packer 1016 mechanically coupled through a manifold 1014 to the upper packer 1012, the lower packer positioned downhole from the casing perforations. Upper packer 1012 includes an upper zonal seal 1013 that, when activated as shown in FIG. 1A, extends to contact an inner surface 1002 of the casing 1001, forming a fluid seal with the inner surface 1002. Lower packer 1016 includes a lower zonal seal 1017 that, when activated as shown in FIG. 1A, extends to contact an inner surface 1002 of the casing 1001, forming a fluid seal with the inner surface 1002.

When activated as illustrated in FIG. 1A, upper zonal seal 1013 and lower zonal seal 1017 provide an isolation zone 1018 that includes a portion of the wellbore within casing 1001 that is sealed off from being in fluid communication with other portion of the wellbore, both above the upper zonal seal and below the lower zonal seal. In various embodiments, the isolation zone 1018 includes a portion of the wellbore that includes casing perforations 1003, and thus fractures 1004, being in fluid communication with the isolation zone. Manifold 1014 is also included within isolation zone 1018, wherein manifold 1014 includes one or more openings 1015, which are configured to provide fluid communication between inner cavity 1028 of the manifold and the isolation zone 1018. Coiled tubing 1025 includes a fluid passageway extending throughout the length of the coiled tubing, the fluid passageway configured to allow a fluid, such as a fracturing fluid, to the plug assembly and isolation zone, 1018. The fluid may be provided from an uphole location, such as from a location above the surface where the borehole penetrates, to the top coupling 1011, at various pressures required to perform fluid treatment operations, such as a fracturing operations, on the formation material 1005 outside casing 1001. The flow of fluid provided to the plug apparatus through coiled tubing 1025 is illustratively represented in FIG. 1A by arrow 1026. Both the top coupling 1011 and the upper packer assembly 1012 include fluid passageways, respectively, that are in fluid communication with the fluid passageway extending through the coiled tubing 1025, and the inner cavity 1028 of manifold 1014, as illustratively represented by arrow 1027. As such, a fluid provided to the plug apparatus 1010 via coiled tubing 1025 may flow through the top coupling 1011, through upper packer assembly 1012, and into inner cavity 1028 of the manifold 1014. As described above, manifold 1014 includes one or more opening 1015, which are configured to allow fluid received at the inner cavity 1028 of the manifold to flow out of the manifold, as illustratively represented in FIG. 1A by arrows 1029, to provide a fluid flow and/or to exert a fluid pressure within the isolation zone 1018. Fluid flows and/or fluid pressures provided to isolation zone 1018 may further be provided to and/or exerted on formation 1005 in the areas of the casing perforations 1003, in various embodiments generating fractures 1004 in the formation material, and/or provide some other type of fluid treatment to the formation material that is proximate to casing perforations 1003.

In addition, embodiments of system 1000 include lower packer 1016 including a fluid passageway the provides fluid communication between the inner cavity 1028 of manifold 1014 and a telemetry unit 1020 that in various embodiments is coupled to the downhole side of the lower packer. In various embodiments, telemetry unit 1020 includes a guide nose 1022, which may be made of a material such as steel, and be shaped in a way, such as having a rounded shape, which is configured to protect telemetry unit 1020, and to aid in guiding the plug apparatus 1010 along a path through the casing 1001 when the packer assembly is being lowered or raised within the casing. The fluid passageway may be configured to provide a flow of fluid from the inner cavity 1028, through the lower packer 1016, and to the telemetry unit 1020, as illustratively represented by arrow 1030 in FIG. 1A.

Telemetry unit 1020 includes a fluid signal generator 1021. Fluid signal generator 1021 may be any embodiment of the fluid signal generators described throughout this disclosure, or any equivalents and/or variations thereof. In various embodiments, fluid signal generator 1021 is configured to be operated to controllable generate fluid signal pulses within the fluid column coupling the telemetry unit 1020 to the fluid column within coiled tubing 1025 through the fluid passageways extending through the plug apparatus as described above. The fluid pulse signals may be generated for example by controllably operating the fluid signal generator to at times block, and at other times allow, a flow of fluid provided to the fluid signal generator from the plug apparatus 1010 to flow out of the telemetry unit through exit port 1031, as represented by arrow 1032. In various embodiments, the fluid pulse signals represent data, such as data related to downhole parameters such a fluid flow rates, fluid pressure(s), fluid temperature(s) and/or information related the chemical properties determined for the fluids present in the wellbore, including fluids present within isolation zone 1018, as part of the fluid treatment process. The type of fluid signal generator 1021 that may be included within telemetry unit 1020 is not limited to any particular type of fluid signal generator, and may include any of the embodiments of fluid signal generators described throughout this disclosure, and/or any equivalents thereof. In operation, fluid signal generator 1021 may operate to generate fluid signal pulses that represent data and/or other types of information, wherein the fluid signal pulses are transmitted from the fluid signal generator to another device, such as an acoustic receiver, through the fluid present in the plug apparatus 1010 and extending through at least a portion of the coiled tubing 1025 coupled to the packer assembly, to a device, such as an acoustic receiver (not shown in FIG. 1A), which can detect the fluid signal pulses.

Figure 1B:
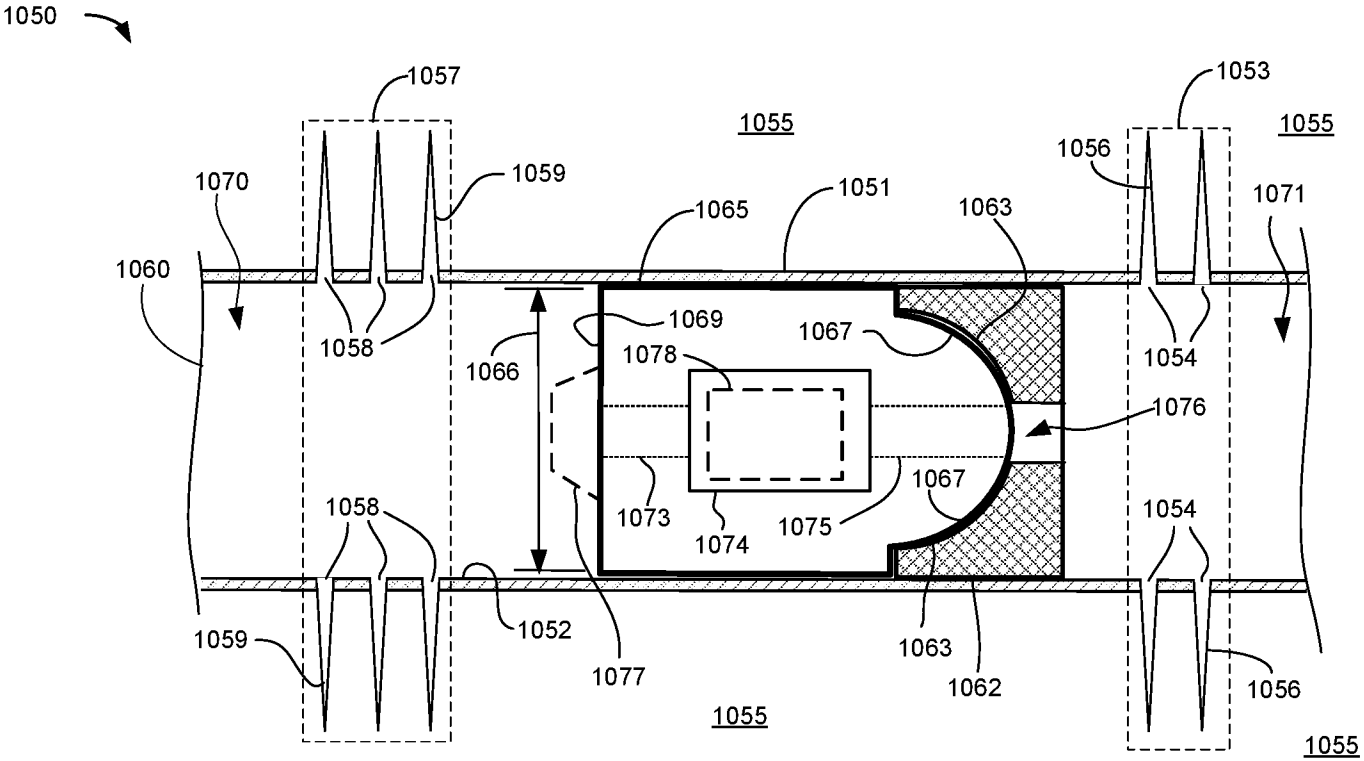
FIG. 1B is a cross-sectional diagram illustrating a wellbore system including a plug apparatus, in accordance with various embodiments.

FIG. 1B is a cross-sectional diagram illustrating a wellbore system 1050 including plug apparatus 1065, according to various embodiments. As illustrated in FIG. 1B, plug apparatus 1065 is positioned within a casing 1051 at a location that is downhole of one or more casing perforations 1058 and uphole of one or more casing perforations 1054. Casing perforation 1054 may be included in a fracture zone 1053, and may include one or more fractures 1056 extending into formation material 1055 in the areas outside the casing 1051 and proximate to casing perforations 1054. A second fracturing zone 1057 may include one or more fractures 1059 extending into formation material 1055 from casing perforations 1058. In various embodiments, plug apparatus 1065 may be an example of plug apparatus 112 and/or plug apparatus 114, as illustrated and described above with respect to FIG. 1.

Referring again to FIG. 1B, plug apparatus 1065 is illustrated in a seated position proximate to and uphole from seat 1062. Seat 1062 may be located at a position within casing 1051 between fracturing zones 1053 and 1057, and is attached, for example by being welded to the casing 1051, so that the seat is not moveable relative to its location along a longitudinal axis of the casing. Seat 1062 includes a fluid passageway 1076 that is configured to provide fluid communication between space 1070, which is uphole relative to the seat, and space 1071, which is downhole of the seat, prior to having plug apparatus 1065 being provided downhole and brought into sealing contact with the seat. In various embodiments, with seat 1062 in position within casing 1051, and in some embodiments having completed a fluid treatment process performed on space 1071 and fractures 1056, the plug apparatus 1065 is pumped or dropped downhole in an orientation so that a sealing surface 1067 of the plug apparatus is orientated downhole relative to a front face 1069 of the plug apparatus. A cross-sectional dimension, as illustratively represented in FIG. 1B by arrow 1066, and a general shape of the plug apparatus 1065 in cross-section is configured so that the orientation of the plug apparatus with the inner lining 1052 of casing 1051 will be maintained as shown in FIG. 1B during the time the plug apparatus is being pumped or dropped downhole, including when the plug apparatus reaches the location within casing 1051 of seat 1062. In various embodiments, as the plug apparatus 1065 is being pumped or dropped downhole, fluid passageway 1076 extending through the seat 1062 allows fluid now positioned between the seat and the plug apparatus to be expelled through the fluid passageway 1076 into space 1071, thus allowing plug apparatus to move toward seat 1062 without the need to overcome fluid pressure that might otherwise build up between the plug apparatus and the seat.

Once plug apparatus 1065 has reached to location of the seat 1062, the sealing surface 1067 of the plug apparatus may be brought into physical contact with a sealing surface 1063 of the seat, and thus forming a fluid tight seal between the plug apparatus and the seat, providing a fluid seal between space 1070 and space 1071. Additional fluid pressure applied within space 1070, for example as part of a fluid treatment process applying fluid for example from the surface of the wellbore, will also be exerted at the front face 1069 of the plug apparatus, further aiding in providing a fluid seal between the plug apparatus and the seat via sealing surface 1063 of the seat and sealing surface 1067 of the plug apparatus. Once plug apparatus 1065 is in place as shown in FIG. 1B, fluid pressure may be provided from uphole (to the left of break line 1060 in FIG. 1B), in order to perform a fluid treatment process, such as a fracturing process, on the fractures 1059, while isolating the previously treated fractures 1056 from any treatment process(es) being applied to fractures 1059.

Embodiments of plug apparatus 1065 also include a telemetry unit 1074. Telemetry unit 1074 is in fluid communication with space 1070 through inlet passageway 1073, which extends from the telemetry unit to the front face 1069 of the plug apparatus. Telemetry unit 1074 is also in fluid communication with space 1071 through outlet passageway 1075, which extends from the telemetry unit to and is aligned with fluid passageway 1076, which extends through seat 1062.

Telemetry unit 1074 further includes a fluid signal generator 1078. Fluid signal generator 1078 may be any embodiment of the fluid signal generators described throughout this disclosure, or any equivalents and/or variations thereof. In various embodiments, fluid signal generator 1078 is configured to be operated to controllably generate fluid signal pulses within the fluid column extending into space 1070, and in various embodiments into a fluid column extending uphole from break line 1060 to another device, such as an acoustic receiver, located uphole of plug apparatus 1065. The fluid signal pulses may be generated for example by controllably operating the fluid signal generator to at times block, and at other times to allow, a flow of fluid provided to the fluid signal generator from space 1070 through inlet passageway 1073 to flow out through outlet passageway 1075 and fluid passageway 1076 into space 1071. In various embodiments, the fluid pulse signals represent data, such as data related to downhole parameters such a fluid flow rates, fluid pressure(s), fluid temperature(s) and/or information related the chemical properties determined for the fluids present in the wellbore, including fluids present within space 1070 and/or space 1071, as part of a fluid treatment process. The type of fluid signal generator 1078 that may be included within telemetry unit 1074 is not limited to any particular type of fluid signal generator, and may include any of the embodiments of fluid signal generators described throughout this disclosure, and/or any equivalents thereof. In operation, fluid signal generator 1078 may operate to generate fluid signal pulses that represent data and/or other types of information that are transmitted from the fluid signal generator to another device, such as an acoustic receiver, through the fluid present in space 1070 and beyond break line 1060. In various embodiments, plug apparatus 1065 includes a screen 1077 covering the inlet opening to filter out particles of a particular size and larger, while still allowing the fluid pulses being generated by the fluid signal generator 1078 to be transmitted to the fluid within and uphole beyond space 1070.

Figure 1C:
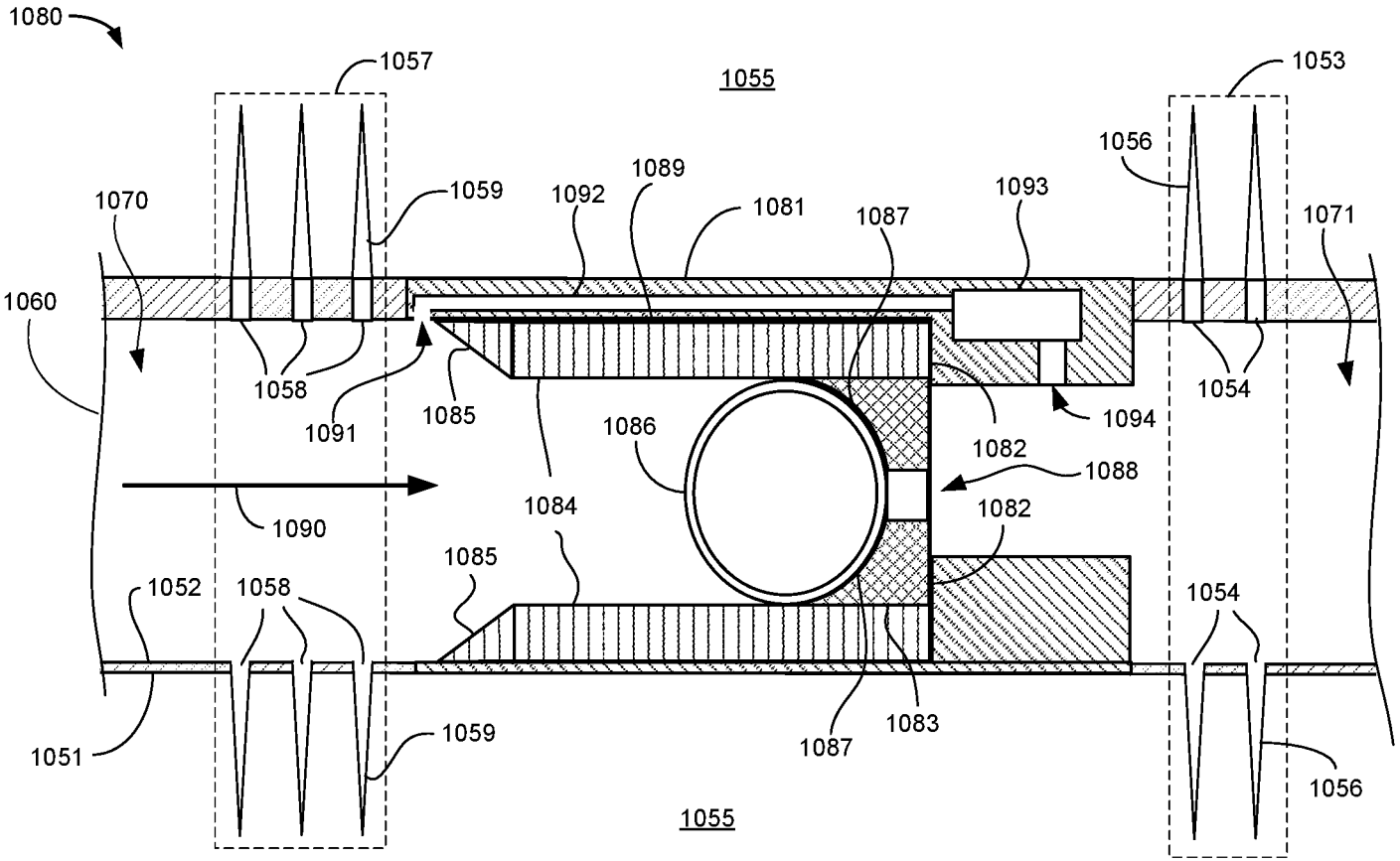
FIG. 1C is a cross-sectional diagram illustrating a wellbore system including a plug apparatus, in accordance with various embodiments.

FIG. 1C is a cross-sectional diagram illustrating a wellbore system 1080 including a plug apparatus 1089, according to various embodiments. As illustrated in FIG. 1C, plug apparatus 1089 is positioned within a casing 1081 at a location that is downhole of one or more casing perforations 1058 and uphole of one or more casing perforations 1054. In arrangements that are the same as or similar to system 1050 of FIG. 1B, system 1080 as illustrated in FIG. 1C includes one or more casing perforations 1054 included in fracture zone 1053, and one or more fractures 1056 extending into formation material 1055 in the areas outside the casing 1081 and proximate to casing perforations 1054, along with a second fracturing zone 1057 including one or more fractures 1059 extending into formation material 1055 in areas outside casing 1081 and proximate to casing perforations 1058. In various embodiments, plug apparatus 1089 may be an example of plug apparatus 112 and/or plug apparatus 114 as illustrated and described above with respect to FIG. 1.

Plug apparatus may comprise a seat 1083 coupled to an extension 1084, wherein the extension may encircle a perimeter of the seat, and wherein the extension 1084 extends, for example as a hollow cylindrical shape, in a direction along a longitudinal axis of the casing 1081 and in a direction away from seat 1083 toward the uphole direction of the well system. Extension 1084 may terminate in a tapered surface 1085 that has a slope directed inward in the direction toward a longitudinal centerline of the plug apparatus. Plug apparatus 1089 may be initially arranged in an undeployed position within casing 1081. In the initial and undeployed position, drop device 1086 is not present and is not in contact with the plug apparatus. In the initial and undeployed position, extension 1084 may be positioned more toward the uphole direction (to the left in FIG. 1C), so that the outer surfaces of the extension 1084 are proximate to and cover over perforations 1058 and inlet port 1091. In some embodiments, while in this undeployed position, a fluid treatment process, such as a fracturing process, may be performed on fracture zone 1053, wherein fluid and/or fluid pressure applied to space 1070 may pass through fluid passageway 1088 of seat 1083, and be applied to fracture zone 1053 via space 1071.

Plug apparatus 1085 as shown in FIG. 1C is in a deployed position, wherein drop device 1086, which may be a spherical shaped device or a dart, has been pumped down or dropped into the well system 1080, for example using fluid pressure provided uphole of space 1070, so that drop device 1086 moves toward and engages with the seat 1083 of the plug apparatus. In various embodiments, drop device 1086 reaches the tapered surfaces 1085 of the plug apparatus, wherein the tapered surfaces aid in guiding the drop device toward and into contact with the sealing surface 1087 of the seat 1083. Fluid passageway 1088, which extends through the seat 1083, may allow any fluid pressure developing between the drop device 1086 and the seat 1083 as the drop device moves toward the sealing surface 1087 to be relieved by a fluid flow through fluid passageway 1088 and into space 1071, thus allowing the drop device to engage with and form a fluid seal with the seat. Once drop device 1086 is seated on the seat 1083, further fluid pressure within space 1070 will press against the drop device with a force adequate to move the plug apparatus from the undeployed position described above to the deployed position as shown in FIG. 1C. The casing 1081 may include one or more steps 1082 that act as stops, and thereby limit the movement of the plug apparatus in the downhole direction so that the plug apparatus no longer covers the perforations 1058 in the second fracture zone, but also has not moved far enough to cover the perforations 1054 in the first fracture zone 1053. While in the deployed position as illustrated in FIG. 1C, plug apparatus 1089 forms a fluid and pressure seal between space 1070 and space 1071. As such, the fractures 1056 of the first fracture zone 1053 are isolated from fluid pressure and any fluid treatment processes that may be applied to fractures 1059 in the second fracture zone 1057 by fluid present in space 1070.

In addition, once plug apparatus 1089 is in the deployed position as illustrated in FIG. 1C, inlet port 1091 is open to and in fluid communication with space 1070. Inlet port 1091 is in fluid communication with fluid passageway 1092, which extends from the inlet port to telemetry unit 1093. Telemetry unit 1093 is also in fluid communication with outlet passageway 1094, which extends from the telemetry unit to space 1071. Telemetry unit 1093 further includes a fluid signal generator 1095. Fluid signal generator 1095 may be any embodiment of the fluid signal generators described throughout this disclosure, or any equivalents and/or variations thereof. In various embodiments, fluid signal generator 1095 is configured to be operated to controllably generate fluid signal pulses within the fluid column extending through fluid passageway 1092 and inlet port 1091, and into space 1070, and in various embodiments into a fluid column extending uphole from break line 1060 to another device, such as an acoustic receiver, located uphole of plug apparatus 1089. The fluid signal pulses may be generated for example by controllably operating the fluid signal generator to at times block, and at other times to allow, a flow of fluid provided to the fluid signal generator from space 1070 through fluid passageway 1092 and to flow out through outlet passageway 1094 into space 1071. In various embodiments, the fluid pulse signals represent data, such as data related to downhole parameters such a fluid flow rates, fluid pressure(s), fluid temperature(s) and/or information related the chemical properties determined for the fluids present in the wellbore, including fluids present within space 1070 and/or space 1071, as part of a fluid treatment process.

The type of fluid signal generator 1098 that may be included within telemetry unit 1093 is not limited to any particular type of fluid signal generator, and may include any of the embodiments of fluid signal generators described throughout this disclosure, and/or any equivalents thereof. In operation, fluid signal generator 1098 may operate to generate fluid signal pulses that represent data and/or other types of information that are transmitted from the fluid signal generator to another device, such as an acoustic receiver, through the fluid present in space 1070 and beyond break line 1060. In various embodiments, plug apparatus 1089 may include a screen or other device (not specifically shown in FIG. 1C) covering the inlet port 1091 to filter out particles of a particular size and larger, while still allowing the fluid pulses being generated by the fluid signal generator 1098 to be transmitted to the fluid within and uphole beyond space 1070.

Figure 2:
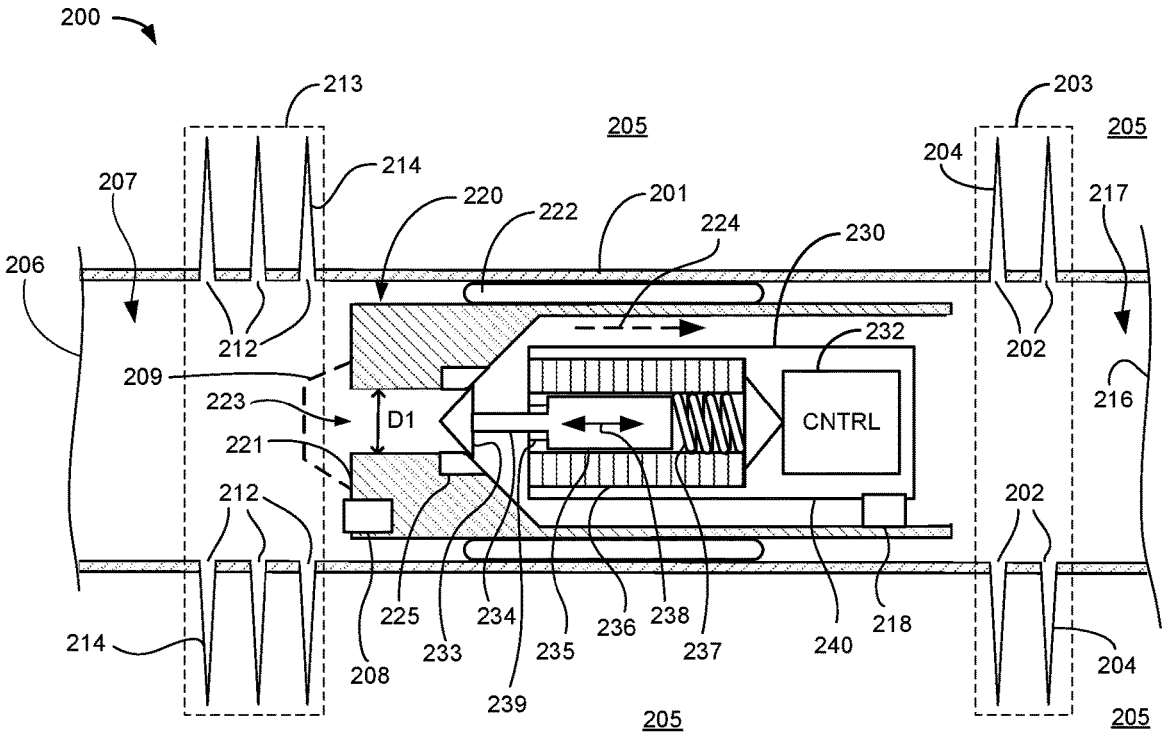
FIG. 2 is a cross-section diagram illustrating a fluid signal generator deployed within a wellbore in accordance with various embodiments.

FIG. 2 is a cross-sectional diagram illustrating a wellbore system 200 including a plug apparatus (plug) 220 comprising a fluid signal generator assembly 230 deployed within a wellbore, in accordance with various embodiments. As illustrated in FIG. 2, plug 220 is positioned within a borehole casing 201 that is located downhole and within a borehole formed in formation material 205. Plug 220 is positioned within casing 201 between first fracturing zone 203 and second fracturing zone 213. The second fracturing zone 213 is positioned closest to the uphole inlet 206 of the borehole, which extends to the borehole surface or wellhead of the borehole. The first fracturing zone 203 includes perforations 202 that extend through borehole casing 201, and provide fluid communication between space 207 and fractures 204 that extend into formation material 205. The first fracturing zone 203 is positioned closest to the downhole outlet 216, which in various embodiments extends toward the bottom face or downhole termination of the borehole. The second fracturing zone 213 includes perforations 212 that extend through borehole casing 201, and provide fluid communication between space 217 and fractures 214 that extend into formation material 205.

Plug 220 is configured to provide a sealing separation between space 207 included within the casing 201, which is located uphole from the plug 220, and space 217 included within casing 201, which is located downhole from plug 220. Plug 220 comprises a housing 221 that occupies a portion of the space within casing 201 in cross-section, and a sealing member 222 that is proximate to, and in some embodiments encircles the housing 221. Sealing member 222 is configured to seal the outside surface(s) of the housing 221 to the inner surface(s) of the casing 201 so that any fluids present in space 207 are sealed off from space 217, and are therefore prevented from passing around the outside surfaces of the plug 220 once plug 220 is positioned at the desired location within the casing 201 and sealing member 222 is activated to be in a sealing configuration. As further described below, embodiments of plug 220 include the above-mentioned fluid signal generator assembly (assembly) 230 that is configured to controllably allow fluid communication between space 207 and space 217 through one or more fluid passageways located with the housing 221 of plug 220, and thereby produce one or more fluid pulses that may be used to communicate data as fluid signals. Although sealing member is illustrated in FIG. 2 as an inflatable seal, in alternative embodiments, sealing member may preventing fluid from passing around the plug apparatus using cement to seal the plug to the tool body, or other devices such as a compression-set packer preventing flow, a swellable packer preventing flow, or a chemically reacting packer preventing flow.

In various embodiments, assembly 230 comprises a controller 232 that is electrically and/or mechanically coupled to additional devices that allow controller 232 to controllably allow or block a flow of fluid, such as a fracturing fluid, between space 207 and space 217. In various embodiments, the devices included in assembly 230 and configured to be controlled by controller 232 to generate fluid pulses may include some combination of a stopper 233, a connector 234, an actuator block 235, an actuator 236, and/or a biasing member 237. As shown in FIG. 2, stopper 233 is mechanically coupled to connector 234 at a first end of the connector, wherein a second end of connector 234 is mechanically coupled to actuator block 235. Actuator block 235 is configured in some embodiments to be movable back and forth in a direction that is parallel to a longitudinal axis of the plug 220 and/or the casing 201, as indicated by arrow 238. Movements of the actuator block 235 are transferred to the stopper 233 through connector 234.

In various embodiments, when actuator block 235 is extended to the left in FIG. 2, stopper 233 is configured to also move to the left to a position where the stopper makes contact with a sealing portion of housing 221, which may comprise a housing seat 225. Housing seat 225 may be formed from a material having a shaped surface configured to provide a fluid seal when brought into physical contact with the stopper 233. When stopper 233 is extended in the left-hand direction so that the stopper is brought into contact with housing seat 225 with a pre-determined level of force, the housing opening 223, which is in fluid communication with space 207, is sealed off at the end of the housing opening 223 proximate to the housing seat 225, and any fluid communication between space 207 and space 217 through the plug 220 is substantially or completely blocked. When actuator block 235 is extended to the right in FIG. 2, stopper 233 is configured to move to the right, and away from housing seat 225. When stopper 233 is extended in the right-hand direction, the end of housing opening 223 closest to housing seat 225 provides an opening that provides fluid communication between space 207 and space 217. Due to the pressure of the fluid present in space 207, for example fluid pressure provided by one or more uphole devices as part of a fracturing operation, a flow of some portion of the fluid present in space 207 may flow through housing opening 223, past stopper 233, and through one or more passages internal to the housing 221 of plug 220 (for example indicted by dashed arrow 224), and into space 217. A mechanical filter 209, such as a sand screen, may be placed in the flow path to the housing opening 223 so that the injected proppant would be restricted from entering valve assembly.

In various embodiments, the flow of fluid provided through housing 221 when stopper 233 is moved away from housing seat 225 generates a level of fluid flow and/or a change in fluid pressure in the fluid present in space 207 that can be detected and interpreted, for example by a monitoring system located on the surface, as a first data state, while the lack of fluid flow provided through housing 221 when stopper 233 is moved to be in contact with housing seat 225 to form a fluid seal between space 207 and space 217 can be detected and interpreted, (again for example by the monitoring system located on the surface), as a second data state. Thus, by controllably moving stopper 233 into contact with and away from housing seat 225, and thus respectively stopping and allowing a flow of fluid between space 207 and space 217 through plug 220, a series of different data states can be generated in a column of fluid within space 207 and casing 201 as a result of the changes in the levels of fluid flows and/or pressure levels resulting from the control over the position of stopper 233, thereby generating data that is communicated to the surface through the varying levels of fluid pressures and/or flows generated by the fluid signal generator 230 under the control of controller 232.

In various embodiments, control of the movements of actuator block 235, and thus the movements of stopper 233 through connector 234, may be provided by an electromechanical arrangement, such as a solenoid type arrangements or such as a ferroelectric actuated arrangement or an electric motor and ball screw arrangement, wherein actuator 236 may be an electrical coil or inductor, and configured to be controlled by controller 232 to generate electromagnetic field(s) that controllably move actuator block 235 back and forth, as indicated by arrow 238. In various embodiments, an urging member 237, such as a spring, may be included in plug 220 and configured to urge actuator block 235 in a left-hand direction as shown in FIG. 2, and thus urge stopper 233 in a direction toward housing seat 225. In various embodiments, urging member 237 may apply an adequate force against actuator block 235, which is thereby applied to stopper 233 through connector 234, such that stopper 233 forms a fluid seal against housing seat 225 with adequate force to prevent the flow of fluids from space 207 to space 217 through housing opening 223 without the need for additional forces to be applied to actuator block 235 by the actuator 236. In various alternative embodiments, urging member 237 is configured to supplement the force applied to actuator block 235 by actuator 236, and thus to stopper 233, in order to allow stopper 233 to contact housing seat 225 with a force adequate to prevent the flow of fluids from space 207 to space 217 through housing opening 223.

In various embodiments, actuator 236 is configured to apply a force, for example an electromagnetic force, to actuator block 235 that is adequate to cause actuator block 235 to move in a right-hand direction as illustrated in FIG. 2, and thus allow stopper 233 to move away from housing seat 225, thereby allowing fluid communication and/or a fluid flow between space 207 and 217. In various embodiments the force applied by actuator 236 to actuator block 235 to move actuator block in a right-hand direction in FIG. 2 is a force that is adequate to overcome the force being applied to actuator block 235 by urging member 237 when an urging member is provided as part of plug 220. In various embodiments, actuator block 235 may be formed of material that is attracted by a magnetic field, such as a ferrous compound, and/or may itself be magnetic, such as a material formed as a permanent magnet. By operating controller 232 to control actuator 236 using variations in electromagnetic field(s), plug 220 may controllably manipulate the position of actuator block 235, and thus the position of stopper 233 relative to housing seat 225, and thereby controllably generated fluid pulses in a fluid that is present in space 207. These fluid pulses can represent data that is then communicated through the fluid present in space 207 and extending through the borehole, for example to a wellhead of the borehole, to a monitoring device, such as a monitor device at the surface 101. In various embodiments, actuator 236 may include one or more built-in position sensors that are configured to sense a position of actuator block 235, and to provide feedback signal(s) to controller 232 indicative of the relative position of actuator block 235 within the actuator. In various embodiments, controller 232 is configured to utilize the information provided by the built-in position sensors to determine the position of stopper 233 and/or to confirm the proper operation of the movements of the actuator block 235 and/or the operation of assembly 230 in general.

In various embodiments, instead of using electro-mechanical devices, controller 232 may include a pneumatic or hydraulically operated system for actuating and controlling movements of the actuator block 235. For example, controller 232 may be configured to operate a fluid pump and a set of valves coupled to fluid lines extending to both ends of the actuator 236 (not shown in FIG. 2, but for example as illustrated in FIG. 8 as the fluid pump/valves 820 and fluid ports 821. In embodiments including the pneumatic or hydraulically operated system, controller 232 may be configured to controllably apply fluid pressure to a first end of actuator block 235 to extend stopper 233 to contact housing seat 225, and to apply fluid pressure to a second end of actuator block 235 opposite the first end in order to retract stopper 233 in a direction away from housing seat 225. By controlling the movements of actuator block 235 and thus the movements of stopper 233, controller 232 can control the opening and closing of housing opening 223, and thus control the flow of fluid through housing opening 223 to generate the fluid signals as described above.

In various embodiments, a power source, such as a battery, is provided as part of assembly 230, for example integrated into controller 232, to provide electrical power used to operated assembly 230, including providing electrical power to actuator 236 to produce electromagnetic fields used to move actuator block 235, and/or to provide power to operate and control pumps and valves used for pneumatic/hydraulic control of the actuator and actuator block of assembly 230. In various embodiments, power, such as electrical power, may be provided to assembly 230 by a set of electrical conductors or an electrical cable coupling the assembly to a power source located on the surface. In various embodiments, controller 232 may be partially powered by electrical power, for example by a battery included in assembly 230, and also provided with a source of pressurized fluid, such as air or hydraulic fluid, from a source external to the assembly 230, the pressurized fluid configured for operating the movements of the actuator block 235 within the plug housing 221 of the assembly 230 under the control of controller 232.

In various embodiments, one or more sensors 208 may be located proximate to or incorporated into plug 220 such as the housing portion of plug 220, and configured to sense one or more parameters associated with space 207. For example, sensors 208 may be configured to sense fluid pressure levels, temperatures, and/or one or more other parameters, such as parameters related to chemical properties of fluid(s) present in space 207. Sensors 208 may be communicatively coupled, for example via a wired or a wireless connection, to a sensor interface included in controller 232. Controller 232 may be configured to receive output signals provided by the one or more sensors 208, such as electrical output signals provided by the one or more sensors 208, the output signals representative of measurements taken by the one or more sensors related to one or more of the parameters being sensed by the sensors 208, such as real-time pressure and/or temperatures related to the fluid(s) present in space 207. In various embodiments, sensors 208 may include one or more sensors configured to detect the changes in fluid pressure and/or fluid flows generated by the opening and closing of the opening 223 due to the operation of the stopper 233, and provide a feedback signal to controller 232 based on the detection of the fluid signals detected in the fluid present in space 207. In various embodiments, these feedback signal(s) may be utilized by controller 232 to confirm the proper operation of the assembly 230 in providing fluid signals to the fluid present in space 207.

In various embodiments, one or more sensors 218 may be located proximate to or incorporated into plug 220, and configured to sense one or more parameters associated with space 217. For example, sensors 218 may be configured to sense fluid pressure levels, temperatures, flow rates, acoustic noises, and/or one or more other parameters, such as parameters related to chemical properties of fluid(s) present in space 217. Sensors 218 may be communicatively coupled, for example via a wired or a wireless connection, to a sensor interface included in controller 232. Controller 232 may be configured to receive output signals provided by the one or more sensors 218, such as electrical output signals provided by the one or more sensors 218, the output signals representative of one or more of the parameters being sensed by the one or more sensors 218, such as real-time pressure and/or temperatures related to the fluid(s) present in space 217.

Controller 232 may be configured to process the output signals provided by the one or more sensors of sensors 208 and/or sensors 218, and generate data based at least in part on these output signals. Controller 232 may be further configured to controllably operate the devices, such as the actuator 236, with or without the aid of a biasing member such as biasing member 237, to control stopper 233 in order to generate a series of fluid pulses in the fluid present in space 207 in order to communicate, for example to the surface or another uphole device, the generated data via the series of fluid pulses produced in the column of fluid present in space 207 and extending in some embodiments to the surface of wellbore where plug 220 is installed.

In various embodiments, portions of the assembly 230, such as plug housing 221, stopper 233, housing seat 225, and connector 234, are formed from a material that is inert relative to the various chemicals and/or particulates that may be present in the fluid provided to space 207, and passing through the plug 220. In various embodiments, one or more of these components may be formed from material comprising a metal (such as steel, magnesium, or aluminum), a polymer (such as a polymer composite, an aliphatic polyester like PGA, PEEK, or Torlon), or a ceramic (such as carbide, a metal oxide like alumina, or a porcelain). In various embodiments, the portions of the plug 220 that may come into contact with fluid(s) provided in space 207 and/or passing through the plug may be coated with a different material, such as ceramic, metal, or a polymer, which are inert to and/or are configured to protect the devices coated by the surface from the chemicals and/or particulates that may be provided in the fluid(s) provided to space 207 and/or passing through the plug. For example, face portion and/or outer surfaces of plug housing 221 that are exposed to space 207, the inner surface of housing opening 223, and/or any portion of the passageways within plug 220 where fluids from space 207 may pass through to space 217, may be coated with a material configured to protect the underlying material from the fluids present in these areas.

In various embodiments, an internal dimension D, such as a diameter, of housing opening 223 may be configured in view of various factors, such as the pressures and/or viscosities of the fluids expected to be present in space 207, and/or the overall diameter of the borehole where plug 220 is expected to be deployed. In various embodiment, housing opening 223 is a cylinder shaped passageway having a circular shape in cross section, and having a diameter D1 in a range of 0.050 inches to 3 inches. Non-circular cross sections, such as annular cross sections and geometric shapes are alternative embodiments. In various embodiments, the face of stopper 233 may be angled relative to the longitudinal axis of the plug, for example having a pointed shape as shown in FIG. 2, which helps the actuator 236 overcome the forces of the fluid pressures that may be exerted on the face of the stopper as the actuator operates to open and close the housing opening 223 using the stopper.

In various embodiments, portions of the fluid signal generator 230, such as controller 232, actuator 236, actuator block 235, and biasing member 237 may be enclosed in a housing 240 configured to isolate and protect these devices from any fluid present in space 207, and from any fluid passing through plug 220 to space 217. In various embodiments, a seal 239 is provided to seal a portion of housing 240 to allow for connector 234 to extend out of the housing 240 to couple with stopper 233 while preventing the fluid present in the housing opening 223 and passing through plug 220 from entering the housing 240 and coming into contact with the devices located within housing 240. In various embodiments, housing 240 may be physically coupled to plug housing 221 in order to secure the position of assembly 230 and stopper 233 relative to plug housing 221, while still providing one or more passageways, for example as illustrated by arrow 224, for the flow of fluid around housing 240 and through plug 220.

Figure 3:
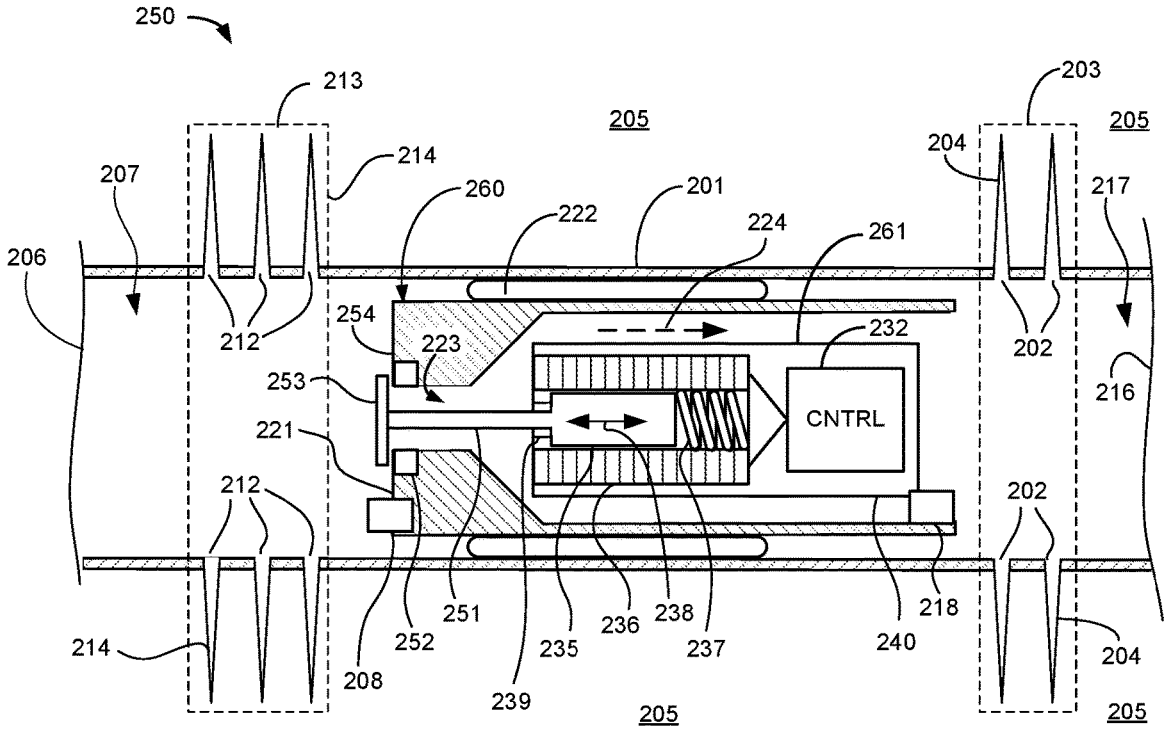
FIG. 3 is a cross-section diagram illustrating a fluid signal generator deployed within a wellbore in accordance with various embodiments.

FIG. 3 is a cross-sectional diagram illustrating a wellbore system 250 including a plug apparatus (plug) 260 comprising a fluid signal generator assembly (assembly) 261 deployed within a wellbore, in accordance with various embodiments. Plug 260 as illustrated in FIG. 3 includes features that are the same or are similar to the features described above with respect to plug 220 and FIG. 2, and therefore retain the same references numbers used to label these corresponding features as illustrated in FIG. 2. Plug 260 may provide any and/or all of the same features, and be configured to perform any and/or all of the same function described above or otherwise attributable to plug 220 of FIG. 2, with the variations as further described below for plug 260 of FIG. 3.

As shown in FIG. 3, the assembly 261 of plug 260 includes a connector 251 that is coupled to actuator block 235 at a first end of the connector, and to stopper 253 coupled to connector 251 at a second end of the connector opposite the end coupled to the actuator block. In various embodiments of plug 260, connector 251 has a longitudinal dimension that allows the second end of the connector to extend through opening 223 of plug 260 to a position beyond a front face 254 of the plug housing 221, the front face 254 having a surface defining an end of the plug housing that is exposed to space 207, and provides at least some portion of the fluid boundary of space 207. Stopper 253 may be formed as a flat shaped material, for example having a disc shape, and having a thickness dimension the extends radially in all directions from the point where stopper 253 connects to connector 251, so that a surface of the stopper extends beyond the cross-sectional interior dimension(s) of housing opening 223.

A surface of stopper 253 may be configured to be brought into contact with housing seal 252 provided at, or proximal to, the front face 254 of housing 221, so that stopper 253 forms a fluid seal configured to substantially or completely block off the uphole opening of housing opening 223, and thereby seal off fluid flows between space 207 and 217 through the one or more fluid passageways extending through plug 260, as illustrative represented by dashed arrow 224. In various embodiments, housing seal 252 provides a sealing surface that is flush with front face 254. In various embodiments, the housing seal 252 is recessed within the plug housing 221 so that when stopper 253 is brought into contact with housing seal, the uphole face of stopper 253 is recessed within plug housing 221 and is recessed behind, or is flush with, front face 254. Connector 251 is dimensioned so that when actuator block 235 is extended to the left-hand direction in FIG. 3, stopper 253 is moved away from housing seal 252, and a passageway for the flow of fluid present in space 207 is provided through housing opening 223 and through plug 260, for example as illustrated by dashed arrow 224. Controller 232 may be configured to operate in any of the ways and by means of any of the devices described above with respect to plug 220 and FIG. 2 in order to control the position of stopper 253 to provide fluid signals in the fluid present in space 207.

In various embodiments, stopper 253 is configured to be received at the front face 241 of housing 221 and to form a fluid seal between space 207 and opening 223 when the stopper is fully received at the housing seat 252. In the embodiment illustrated in FIG. 3, fluid pressure present in space 207 may exert a force on the uphole face of stopper 253 that aids in forming the seal between stopper 253 and housing seat 252. In various embodiments, an urging member 237, such as a spring, is arranged in assembly 261 in order to help push actuator block 235 to the left in FIG. 3, and thus contribute to any forces exerted on the actuator block 235 by actuator 236 as needed to move stopper 253 away from housing seat 252 and open the passageways(s) through plug 260 for a flow of fluid between space 207 and space 217. An inside dimension, such as a diameter, of housing opening 223, may be determined based on various factors, including the pressure ranges of the fluid expected to be present in space 207 when data is to be communicated using the plug 260, the overall dimension of the borehole casing where the plug is to be installed, the composition of the fluid present in space 207, and for example the dimensions in cross-section of connector 251 present within the housing opening 223. Housing seat 252, stopper 253, and connector 251 may be formed, respectively, from one or more of the materials described above that are inert and/or provide protection from the fluids these devices may come into contact with when located and operating within a borehole environments ads part of a fluid treatment operation. It should be evident that a range of different flow restriction valves could be used. Alternative embodiments use a ball valve, spool valves, needle valves, pinch valves, poppet valves, globe vales, et cetera. Embodiments of plug apparatus 260 may incorporate a mechanical filter (not specifically shown in FIG. 3, but the same or similar to filter 209, FIG. 3), such as a sand screen, may be placed over or in the flow path to the housing opening 223 so that the injected proppant would be restricted from entering valve assembly.

Figure 4A:
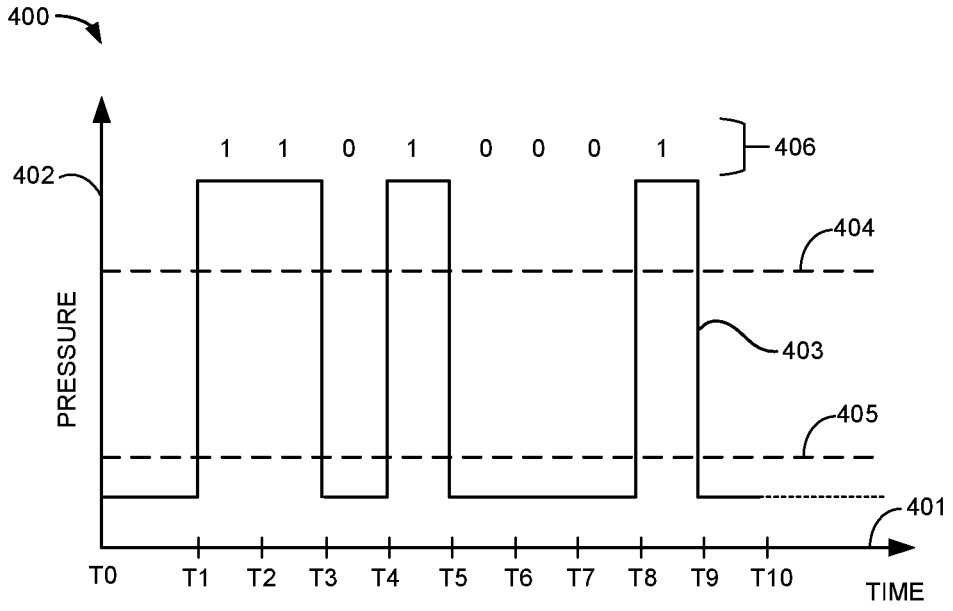
FIG. 4A shows a graph illustrating data generated based on changes in pressure generated by a fluid signal generator, according to various embodiments.

FIG. 4A shows a graph 400 illustrating data generated based on changes in fluid pressure within a borehole generated by a fluid signal generator, according to various embodiments. In various embodiments, the fluid signal generator may be incorporated into plug 220 as illustrated and described above with respect to FIG. 2, or may be incorporated into plug 260 as illustrated and described above with respect to FIG. 3. Referring back to FIG. 4A, graph 400 includes a horizontal axis 401 representing time, and a vertical axis 402 representing fluid pressure, such as a fluid pressure of a fracturing fluid present within a casing of a borehole that is pressurized against a plug, such as plug 220 of FIG. 2 or plug 260 of FIG. 3. Again referring to FIG. 4A, graphical line 403 represents a pressure level present within the fracturing fluid that varies over time. The variations in the pressure level may be interpreted to represent data, such as data bits "1" and "0" as imposed on graph 400 to the left of bracket 406.

In various embodiments, when the pressure level represented by graphical line 403 is below a lower threshold pressure level 405 during a particular time period, that pressure level may be interpreted as a first data value, for example a data value of zero ("0"). This lower pressure level may be generated by operating the fluid signal generator of a plug to allow flow of fluid through the plug or other device where the fluid signal generator is incorporated, thus generating a lower pressure level in the fluid present against one face or side of the plug, such as fluid pressure against the uphole face of the plug. When the pressure level represented by graphical line 403 is above an upper threshold pressure level 404 during a particular time period, that pressure level may be interpreted as a second data value different from the first data value, for example a data value of one ("1"). This higher pressure level may be generated by operating the fluid signal generated to block the flow of fluid through the plug or other device where the fluid signal generator is incorporated, thus retaining a higher pressure level in the fluid present against one face or side of the plug, such as fluid pressure against the uphole face of the plug.

As illustrated in graph 400, during the time between T1 and T2, the pressure level represented by graphical line 403 extends above the upper threshold pressure level 404, and thus may be interpreted to represent a first data value of "1". During the time between T2 and T3, the pressure level represented by graphical line 403 remains extended above the upper threshold pressure level 404, and thus may be interpreted to represent a first data value of "1". During the time between T3 and T4, the pressure level represented by graphical line 403 drops below the lower threshold pressure level 405, and thus may be interpreted to represent a second data value of "0". For the time period between T4 and T5, the pressure level represented by graphical line 403 again extends above the upper threshold pressure level 404, and thus may be interpreted to represent a first data value of "1". During the time period between T5 and T8, the pressure level represented by graphical line 403 extends below the lower threshold pressure level 405, and thus may be interpreted to represent three consecutive data values of "0". During the time between T8 and T9, the pressure level represented by graphical line 403 again extends above the upper threshold pressure level 404, and thus may be interpreted to represent a data value of "1".

As a result of the variations in the pressure levels represented by graphical line 403, data representing a series of data bits, representing data bits "1 1 0 1 0 0 0 1" may be imposed onto a fluid present in the wellbore, wherein these variation in pressure levels may be transmitted through the fluid to a monitoring device, thus allowing data communications to occur through the fluid, and for example to the surface of a wellbore under the control of a fluid signal generator, such as the fluid signal generator 230 included as part of plug 220 or fluid signal generator assembly 261 included as part of plug 260. Without loss of generality, a pulse position encoding scheme or a pulse amplitude modulation encoding scheme could be used. The encoding scheme may include timing pulses, header pulses, address pulses, and error check pulses.

The period of time represented by the time interval between each of times T1 to T10 is not limited to a particular time interval, and in various embodiments may be a time interval between 0.01 seconds and 10 minutes, inclusive. The pressure levels represented by graphical line 403, and the pressure values assigned to the upper threshold pressure level 404 and the lower threshold pressure level 405 are not limited to any particular pressure ranges, respectively, and may be determined by such factors as the pressure levels being applied to the fracking fluid proximate to the fluid signal generator present in the wellbore, and the levels of pressure variations needed in order to generate data signals that may be detected based on the changes in fluid pressure with a minimum level of errors. In various embodiments, a pressure level for the upper threshold pressure level 404 may be set within a range of 1000 PSI to 15,000 PSI inclusive, and a pressure level for the lower threshold pressure level 405 may be set within a range of 500 PSI to 14,500 PSI, inclusive. The pressure range level for the upper threshold will be higher than the pressure level for the lower threshold and this level may be adjusted based on the operating injection pressure.

In various embodiments, the digital signal is encoded by the amount of pressure change. The pressure change for the upper threshold pressure change level 404 may be set within 95% of the average pressure and a pressure change for the lower threshold pressure change level 405 may be set within 90% of the average pressure. The pressure may be averaged over different time windows.

By controlling the pressure level over the time periods represented by T1 to T10 in graph 400, a series of pressure levels may be generated that are representative of data values that may be communicated by way of fluid pressure changes within a column of fracturing fluid to a monitoring device, (such as monitoring system 140 as illustrated and described with respect to FIG. 1) and which may be located on or near a surface of the wellbore. Once received at the surface, the received data may be recorded and/or further processed to make determinations about one or more parameters associated with fluid treatment process, in various embodiments in real or near-real time. The received data in various embodiments may be utilized to determine when and if adjustments to the fluid treatment process, such as changes to the fluid being applied and or to other parameters, such as the rate and/or pressure of the fluid being applied to the borehole as part of the fluid treatment process need to be adjusted.

Figure 4B:
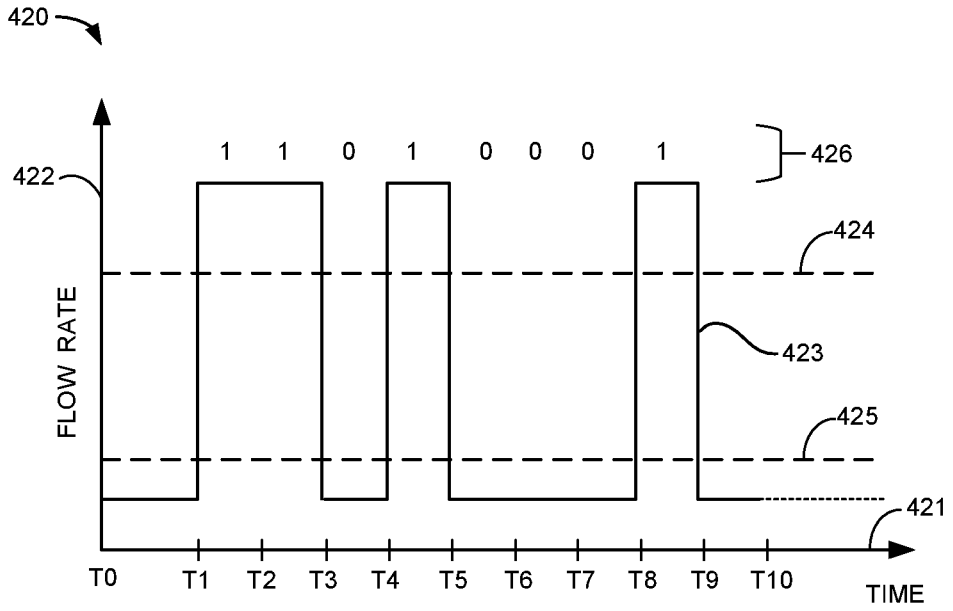
FIG. 4B shows a graph illustrating data generated based on changes in fluid flows generated by a fluid signal generator, according to various embodiments.

FIG. 4B shows a graph 420 illustrating data generated based on changes in fluid flows generated by a fluid signal generator, according to various embodiments. In various embodiments, the fluid signal generator is incorporated into plug 220 as illustrated and described above with respect to FIG. 2, or the fluid signal generator incorporated into plug 260 as illustrated and described with respect to FIG. 3. Referring back to FIG. 4B, graph 420 includes a horizontal axis 421 representing time, and a vertical axis 422 representing fluid flow rates, such as a fluid flow in a fracturing fluid present within a casing of a borehole that is pressurized against a fracturing plug, such as plug 220 of FIG. 2 or plug 260 of FIG. 3. Again referring to FIG. 4B, graphical line 423 represents a fluid flow level present within the fracturing fluid that varies over time. The variations in the flow rate level may be interpreted to represent data, such as data imposed on graph 420 to the left of bracket 426.

In various embodiments, when the fluid flow rate represented by graphical line 423 is below a lower threshold flow level 425 during a particular time period, that flow rate may be interpreted as a first data value, for example a data value of zero ("0"). Low or no fluid flow rates that fall below threshold flow level 425 may occur when a fluid signal generator is operated to block the flow of fluid present at the face of the plug where the fluid signal generator is incorporated from flowing through the plug. When the fluid flow rate represented by graphical line 423 is above an upper threshold flow level 424 during a particular time period, that flow rate may be interpreted as a second data value different from the first data value, for example a data value of one ("1"). This higher level of fluid flow may be generated by operating the fluid signal generated to allow a flow of fluid through the plug or other device where the fluid signal generator is incorporated, thus generating a level of fluid flow in the fluid present against one face or side of the plug, for example through one or more fluid passageways extending through the plug.

By way of example, during the time between T1 and T2, the flow rate represented by graphical line 423 extends above the upper threshold flow rate level 424, and thus may be interpreted to represent a first data value of "1". During the time between T2 and T3, the flow rate represented by graphical line 423 remains extended above the upper threshold flow rate level 424, and thus may be interpreted to represent a first data value of "1". During the time between T3 and T4, the flow rate represented by graphical line 423 drops below the lower threshold flow rate level 425, and thus may be interpreted to represent a second data value of "0". For the time period between T4 and T5, the flow rate level represented by graphical line 423 again extends above the upper threshold flow rate level 424, and thus may be interpreted to represent a first data value of "1". During the time period between T5 and T8, the flow rate represented by graphical line 423 extends below the lower threshold flow rate level 425, and thus may be interpreted to represent three consecutive data values of "0". During the time between T8 and T9, the flow rate represented by graphical line 423 again extends above the upper threshold flow rate level 424, and thus may be interpreted to represent a data value of "1".

As a result of the variations in the flow rates represented by graphical line 423, data representing a series of data bits, including data bits "1 1 0 1 0 0 0 1" may be imposed onto a fluid present in the wellbore, wherein these variation in flow rate levels may be transmitted through the fluid to a monitoring device, thus allowing data communications to occur through the fluid, and for example to the surface of a wellbore under the control of a fluid signal generator, such as the fluid signal generator 230 included as part of plug 220 (FIG. 2) or the fluid signal generator 261 included as part of plug 260 (FIG. 3).

In graph 420 of FIG. 4B, the period of time represented by the time interval between each of times T1 to T10 is not limited to a particular time interval, and in various embodiments may be a time interval between 0.01 seconds and 10 minutes, inclusive. The flow rates represented by graphical line 423, and the flow rate values assigned to the upper threshold flow rate level 424 and the lower threshold flow rate level 425 are not limited to any particular ranges of flow rates, respectively, and may be determined by such factors as the pressure levels being applied to the fracturing fluid proximate to the fluid signal generator present in the wellbore, the volume of fracturing fluid present in the system, and the levels variations in the flow rates that are needed in order to generate data signals that may be detected based on the changes in flow rates with a minimum level of errors. In various embodiments, a flow rate threshold value for the upper threshold flow rate level 424 may be set within a range of 1 barrel per minute (BPM) to 20 BPM inclusive, and a flow rate threshold value for the lower threshold flow rate level 405 may be set within a range of 0.5 BPM to 19.5 BPM, inclusive. The flow rate for the upper threshold will be higher than the flow rate for the lower threshold and this level may be adjusted based on the operating injection flow rate.

In various embodiments, the digital signal is encoded by the amount of flow rate change. The flow rate change for the upper threshold pressure change level 424 may be set within 95% of the average flow rate and a flow rate change for the lower threshold flow rate change level 425 may be set within 90% of the average pressure. The pressure may be averaged over different time windows.

By controlling the variations in the flow rate level over the time periods represented by T1 to T10 in graph 420, a series of varying fluid flow rates in the fracking fluid present in a wellbore, wherein the variation in the fluid flow rates may be representative of data values that may be communicated within a column of fracking fluid to a monitoring device, (such as monitoring system 140 as illustrated and described with respect to FIG. 1), and which may be located on or near a surface of the wellbore. Once received at the surface, the received data may be recorded and/or further processed to make determinations about one or more parameters associated with fluid treatment process, in various embodiments in real or near-real time. The received data in various embodiments may be utilized to determine when and/or if adjustments to the fluid treatment process, such as changes to the fluid being applied an/or to other parameters, such as the rate and/or pressure of the fluid being applied to the borehole as part of the fluid treatment process, need to be adjusted.

Figure 5A:
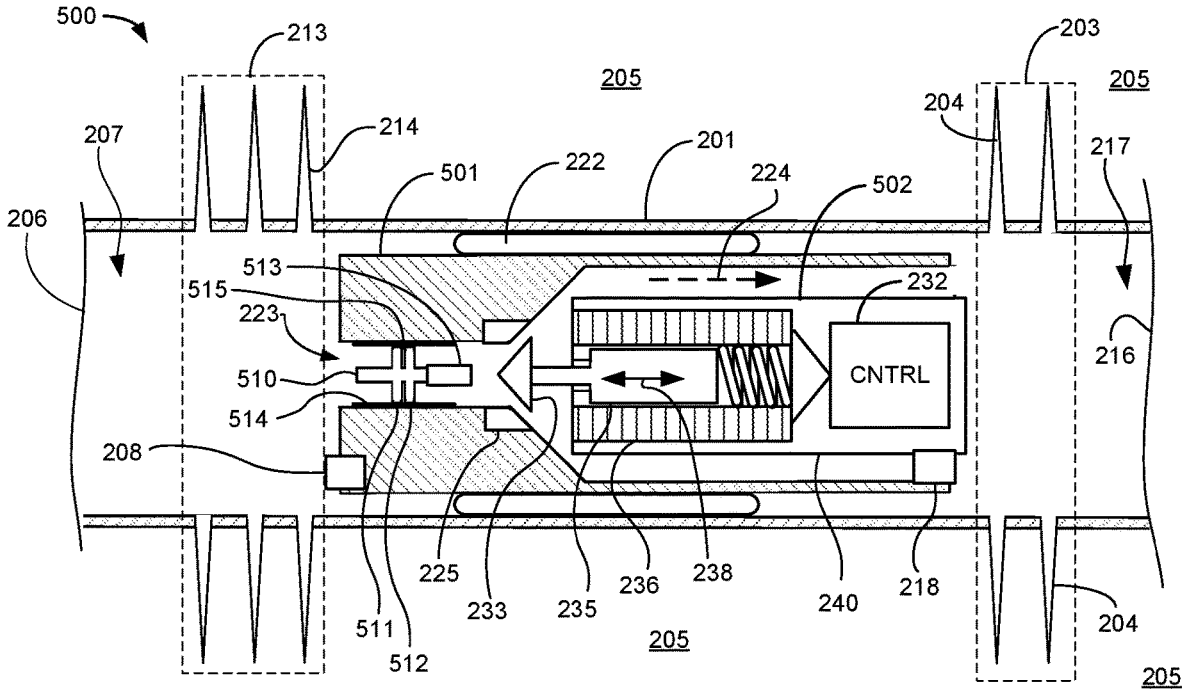
FIG. 5A is a cross-section diagram illustrating a fluid signal generator deployed within a wellbore in accordance with various embodiments.

FIG. 5A is a cross-sectional diagram illustrating a wellbore system 500 including a plug apparatus (plug) 501 comprising a fluid signal generator assembly 502 deployed within a wellbore, in accordance with various embodiments. In various embodiments, plug 501 includes all or similar features as illustrated and described above with respect to FIG. 2 and plug 220, with the variations as further described below. For the sake of clarity, not every feature of plug 220 is labeled in FIG. 5A with respect to plug 501, but may be present in the various embodiments of plug 501. As illustrated in FIG. 5A, plug 501 is positioned within casing 201 between first fracturing zone 203 and second fracturing zone 213. Sealing member 222 is configured to seal the outside surface(s) of the plug apparatus 501 to the inner surface(s) of the casing 201 so that any fluids present in space 207 are sealed off from space 217, and are therefore prevented from passing around the outside surfaces of the plug 501 once plug 501 is positioned at the desired location within the casing 201 and sealing member 222 is activated to be in the sealing configuration.

In various embodiments, plug 501 includes a fluid signal generator assembly (assembly) 502 that incorporates a controller 232 configured to control stopper 233, connector 234, actuator block 235, and actuator 236 using the configurations as described herein, and any variations thereof, with the variations as described below. As illustrated in FIG. 5A, plug 501 includes a siren 510. In various emblements, siren 510 is positioned within the housing opening 223, and is configured to control the flow of fluid through housing opening 223 in order to generate fluid pulse signals in the fluid present in space 207, as further described below. In various embodiments, siren 510 includes a first fixture 511, which comprises a plate with one or more fluid passageways extending through the first fixture, and a second fixture 512, positioned proximate to the first fixture, wherein the second fixture 512 may comprises a plate with one or more fluid passageways extending through the second fixture. One or both of the first fixture 511 and the second fixture 512 are configured to be positional relative to one another, for example rotationally positional relative to one another, so that at one or more positions at least a part of the fluid passageways of first fixture 511 align with at least a portion of one or more of the fluid passageways of the second fixture 512 in order to provide fluid passageway(s) that extend through both the first fixture 511 and the second fixture 512. When in this positional relationship, siren 510 provides one or more fluid passageways that extend through first fixture 511 and second fixture 512, thus providing fluid passageways for fluid to flow through housing opening 223, through siren 510, and toward stopper 233, which may be actuated to an open position (away from housing seat 225), thus allowing a flow of fluid from space 207 through plug 501 (for example as indicated by dashed arrow 224) an into space 217.

The first fixture 511 and the second fixture 512 are also configured to be positional relative to one another, for example rotationally positional relative to one another, so that no portions of the fluid passageways of first fixture 511 align with any portion(s) of the one or more fluid passageways of the second fixture 512. When positioned in this non-aligned positional relationship, siren 510 is configured to substantially or completely block the flow of fluid through housing opening 223. The relative positioning of first fixture 511 and second fixture 512 may be controlled by an actuator 513, which may comprise an electrical motor, such as a stepper or servo motor, or a pneumatic or hydraulic actuator. Actuator 513 may be controlled by controller 232, wherein controller 232 is configured to control a parameter of operation of actuator 513 in order to controllably regulate the flow of fluid from space 207 to space 217 through the housing opening 223 via siren 510, and on through plug 501 via the fluid passageway(s) represented by dashed arrow 224. In various embodiments, (and assuming stopper 233 has been moved to a position away from housing seat 225 in embodiments where stopper 233 is provided), actuator 513 may control the relative positioning of first fixture 511 and second fixture 512 to at times allow a flow of fluid through the siren, and at other times to block any flow of fluid through the siren. By controlling the allowing and blocking of fluid flows through the siren, and in turn through plug 501, controller 232 may generate data in the form of fluid signals in the fluid present in space 207 (for example, as illustrated and described with respect to FIGS. 4A and 4B), wherein the fluid signals may be detected and interpreted by one or more other devices, such as devices located at the surface outside the borehole as described herein, and any equivalents thereof. In embodiments were stopper 233 is provided, stopper 233 may be utilized as a main "ON" and "OFF" seal, wherein when fluid signals are to be generated by the siren 510, controller 232 activates the assembly 502 to move stopper 233 to a position away from housing seat 225, thus providing an fluid passageway from the housing opening 223 to other passageways extending through plug 501, and sealing housing opening 223 using stopper 233 and housing seat 225 when no fluid signal generation is to be performed.

In various embodiments, (and again assuming stopper 233 if provided is positioned to allow a fluid communication between the housing opening 223 and fluid passageways through plug 501), instead of alternatively providing fluid passageway through siren 510 as a first data state and blocking fluid flows through siren 510 as a second data state, configuration of siren 510 may utilize a first rate of alternation between allowing and blocking fluid flows as a first data state, and utilizing a second rate of alternations between allowing and blocking fluid flows as a second data state in order to generate fluid signals that represent data. For example, the relative positioning of first fixture 511 and second fixture 512 may be altered, for example via rotation of one or both of the fixtures, at a first rate of rotation to represent a first data state, and rotated at a second relative rate of rotation that is different from the first rate of rotation to represent a second data state. By controllably varying the rate of relative rotation of the fixtures comprising siren 510 at different pre-determined rates, the flow and/or the pressure of the fluid present in space 207 may be manipulated to produce fluid signals having different frequencies over different time periods that represent and may be interpreted by other devices as data.

Embodiments of actuator 513 may include devices, such as a motor, which change the relative positioning of first fixture 511 and second fixture 512 using rotary motion. In various embodiments, other mechanisms, such as alternatively shifting first fixture 511 and second fixtures 512 between a first position and a second position, which alternatively opens and blocks passageway through siren 510, may be utilized to thereby control the flow of fluid through siren 510, and in turn generate fluid signal in the fluid that may be present in space 207. Power used by actuator 513 may be electrical power, provided for example by a battery (not illustrated in FIG. 5A), and/or by an electrical conductors coupled to an electrical power source (not illustrated in FIG. 5A) that is external to plug 501. In various embodiments, pneumatic or hydraulic fluid may be provided to actuator from an device (not illustrated in FIG. 5A) that is external to plug 520, the fluid provided for example under pressure and operable to be used by the actuator 513 to perform the desired actuations of siren 510 including at least movement of one or both of first fixture 511 and second fixture 512 in order to generate the fluid pulse signals. It should be clear that actuator 513 and stopper 233 are not both required and that a single electromechanical actuator could be used. Embodiments of plug apparatus 501 may incorporate a mechanical filter (not specifically shown in FIG. 5A, but the same or similar to filter 209, FIG. 3), such as a sand screen, may be placed over or in the flow path to the housing opening 223 so that the injected proppant would be restricted from entering valve assembly.

Figure 5B:
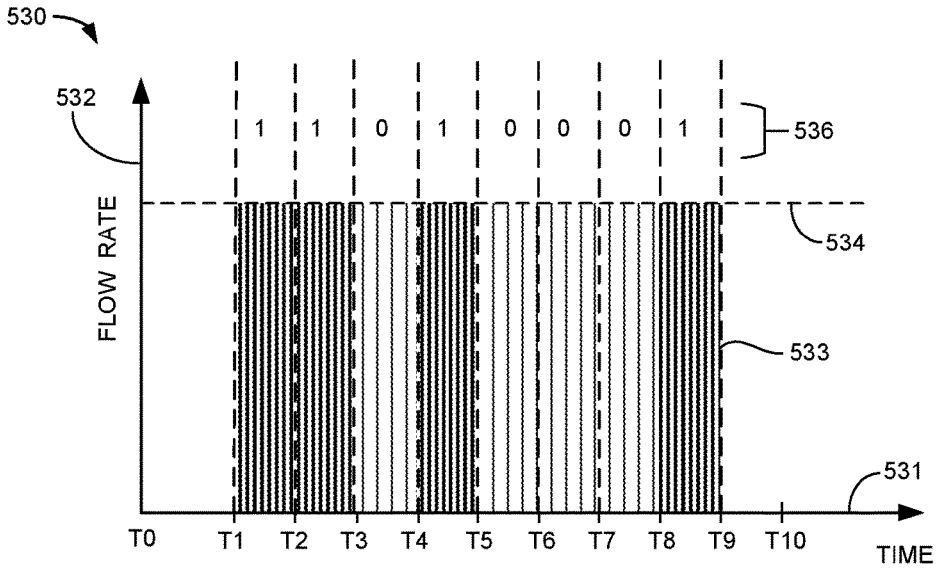
FIG. 5B shows a graph illustrating data generated based on changes in pressure generated by a fluid signal generator, according to various embodiments.

FIG. 5B shows a graph 530 illustrating data generated based on changes in a flow rate generated by a fluid signal generator, according to various embodiments. In various embodiments, the fluid signal generator is a siren incorporated into a plug installed in a wellbore for use as part of a fracking process, for example siren 510 and plug 501 as illustrated and described above with respect to FIG. 5A. Referring back to FIG. 5B, graph 530 includes a horizontal axis 531 representing time, and a vertical axis 532 representing flow rate, such as a fluid flow in a fracturing fluid present within a casing of a borehole that is pressurized against a fracturing plug, such as plug 501 of FIG. 5A. Again referring to FIG. 5B, graphical line 533 represents a flow rate level present within the fracking fluid that varies over time. The variations in the flow rate level may occur at different frequencies, wherein the different frequencies may be interpreted to represent data, such as data imposed on graph 530 to the left of bracket 536.

In various embodiments, when the flow rate represented by graphical line 533 varies from approximately a first flow level 535 to approximately a second pressure level 534 at a first rate (frequency) over a given time period, the rate (frequency) of the flow level variations over that time period may be interpreted as a first data value, for example a data value of zero ("0"). When the pressure level variations represented by graphical line 533 varies from approximately a first flow rate 535 to approximately a flow level 534 at a second rate (frequency) over a given time period that is a different frequency relative to the first frequency, the rate (frequency) of the flow rate variations over that time period may be interpreted as a second data value, for example a data value of zero ("0").

By way of example, during the time between T1 and T2, the frequency of the variations in the flow rate level represented by graphical line 533 represents a first frequency value, and may be interpreted to represent a first data value of "1". During the time between T2 and T3, the frequency of the variations in the flow rate levels represented by graphical line 533 remains at the first frequency value, and thus may be interpreted to represent a first data value of "1". During the time between T3 and T4, the frequency of the variations in the flow rate levels represented by graphical line 533 changes at a different frequency, which is different (i.e., higher or lower frequency) compared to the frequency of the flow rate level changes that occurred between time T1 and T3. The different frequency of flow rate level changes that occurs during the time T3 and T4 may be interpreted to represent a second data value of "0". For the time period between T4 and T5, the frequency of the changes in the flow rate levels represented by graphical line 533 again returns to a rate of the first frequency, and thus may be interpreted to represent a first data value of "1". During the time period between T5 and T8, the frequency of the flow rate levels changes represented by graphical line 533 corresponds with the second frequency, and thus the time periods between T5 and T8 may be interpreted to represent three consecutive data values of "0". During the time between T8 and T9, the frequency of the flow rate level changes represented by graphical line 533 again returns to a rate that corresponds with the first frequency, and thus may be interpreted to represent a data value of "1".

As a result of the variations in the frequency of the flow rate levels represented by graphical line 533, data representing a series of data bits, including data bits "1 1 0 1 0 0 0 1" may be imposed onto a fluid present in the wellbore, wherein these variation in the frequency of the flow rate level changes may be transmitted through the fluid to a monitoring device, thus allowing data communications to occur through the fluid, and for example to the surface of a wellbore under the control of a fluid signal generator, such as the siren 525 included as part of plug 520 as illustrated and described in FIG. 5A.

The period of time represented by the time interval between each of times T1 to T10 is not limited to a particular time interval, and in various embodiments may be a time interval between 0.01 seconds and 10 minutes, inclusive. The flow rate levels represented by graphical line 533, and the flow rate values assigned to the upper flow rate level 534 and the lower flow rate level 535 are not limited to any particular pressure ranges, respectively, and may be determined by such factors as the pressure levels being applied to the fracking fluid proximate to the fluid signal generator present in the wellbore, and the levels of fluid flow variations needed in order to generate data signals that may be detected based on the changes in fluid flows with a minimum level of errors.

Further, the frequencies used to vary the flow rate levels are not limited to any particular frequencies or changes of frequencies, and may include frequencies between 5 Hertz and 500 Kilohertz, inclusive. The difference between the frequency for a variation in the flow rate level determined to represent a first data value and a frequency for a variation in the flow rate levels determined to represent a second data value is not limited to a particular difference in frequency values, and may be determined in order to minimize the amount of data errors that may occur as a result of the generation and detection of these frequency variations. In various embodiments, the different between these frequencies of pressure level variations may be between 1% and 25% of the highest frequency, inclusive.

It would be understood that instead of detecting variations in the frequency of the flow rate levels of the fracking fluid as illustrated in FIG. 5B, the monitoring system used to detect these variations in the fluid pressure levels generated by the siren could also detect differences in the frequencies of fluid pressure pulses instead of the variations in flow rates, and thereby communicate that data generated by the siren based on changes in the frequency of the variations of fluid pressure over given time periods.

Figure 5C:
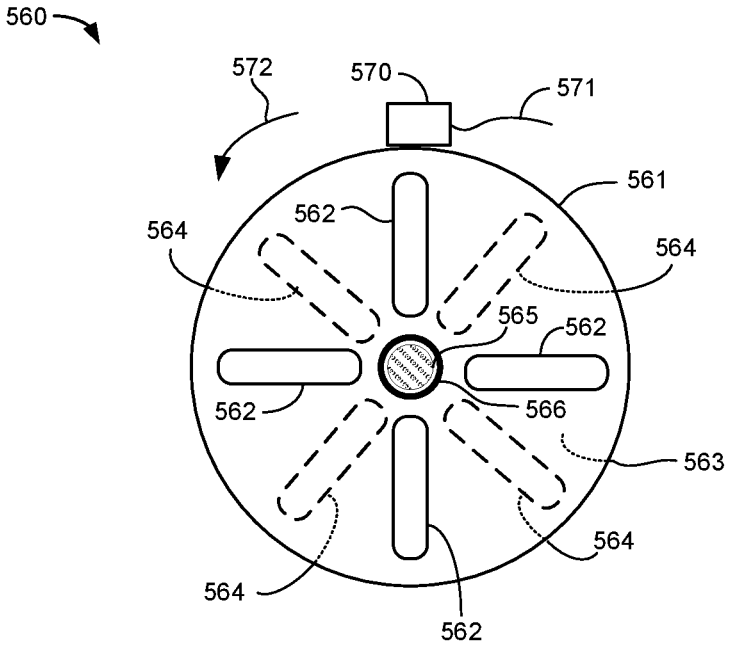
FIGS. 5C and 5D illustrate an end view of a siren according to various embodiments.
Figure 5D:
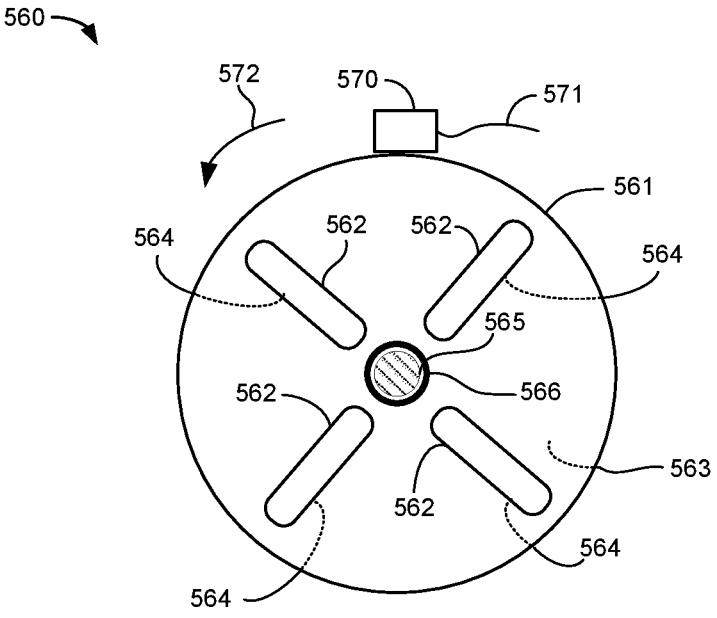

FIGS. 5C and 5D illustrate an end view of a siren 560 according to various embodiments. In various embodiments, siren 560 represents an embodiment of siren 510 as illustrated and described above with respect to wellbore system 500 and FIG. 5A. Referring first to FIG. 5C, siren 560 comprises a first plate 561 having a circular shaped outer perimeter and a thickness dimension (extending into the drawing of FIG. 5C). First plate 561 includes a center opening through which an axel 565 extends. The center opening may include a seal 566 that encircles the axel 565 and provides a fluid seal between the first plate 561 and axel 565. First plate 561 includes a plurality of openings 562 that extend through the thickness dimension of the first plate, and provide passageways for a fluid, such as a fracturing fluid, to pass through the first plate. In various embodiments, first plate 561 is configured to rotate around axel 565, for example in a rotary direction indicated by arrow 572.

A second plate 563 having a circular shaped outer dimension and a thickness dimension is positioned behind first plate 561 (i.e., positioned into the drawing in FIG. 5C relative to the first plate) in a coaxial manner relative to the centers of the plates in cross-section. In some embodiments, second plate 563 may also include a center opening that encircles axel 565. In other embodiments, axel 565 may not extend to or through the second plate, wherein second plate 563 may otherwise be secured to another structure, such as a housing of the siren. Second plate 563 includes a plurality of openings 564 that extend through the thickness dimension of the second plate, and provide passageways for a fluid, such as a fracturing fluid, to pass through the second plate.

When positioned as shown in FIG. 5C, the plurality of openings 562 in first plate 561 do not align with the plurality of opening 564 in second plate 563, and therefore the is no open passageway for fluid to flow from the top side of the first plate, through the first and second plates, and out the bottom of the second plate. In various embodiments, a spacer or seal, such as seal 515 as illustrated in FIG. 5A, may be positioned between first plate 561 and second plate 563 to aid in sealing off a fluid pressure and/or a fluid flow between the first plate and the second plate other than the flow occurring when the openings 562 in the first plate and the opening 564 in the second plate are at least partially aligned. However, as the first plate 561 is rotated relative to the axial orientation of second plate 563, the plurality of opening 562 may be brought into alignment with the plurality of opening 564 in the second plate, and thereby provide a plurality of flow paths through the aligned openings for a flow of fluid from the top of the first plate, through both the first plate and the second plate, and then out of the bottom surface of the second plate.

At some point in the rotation, the plurality of openings in the first plate will completely align with the plurality of openings in the second plate, as illustratively represented by FIG. 5D. When in this position, siren 560 would allow a maximum level of fluid flow through the siren, and may generate a maximum level of pressure drop in the pressure of the fluid present in the proximity of the top face of the first plate. As first plate 561 continues to rotate relative to second plate 563, the alignments of openings 562 with openings 564 will initially decrease, and will eventually return to a position, for examples as shown in FIG. 5C, wherein there is no alignment between the openings 562 and 564. At this point, fluid flow passing through the first plate 561 and the second plate 563 will again be substantially or completely blocked off.

By rotating the first plate 561 relative to the second plate 563 as described above at a first rate of rotation, a variation in the flow rate through siren 560 at a first frequency can be established. By changing that rate of the relative rotation of the first plate 561 relative to the second plate 563, a variation in the flow rate through siren 560 at a second frequency that is different from the first frequency can be established.

In various embodiments, the rotary motion imparted to first plate 561 may be provided by an electrical motor, such as a stepper motor, or other devices, such as a pneumatic or a hydraulic rotary driven device. By varying the rotational rate of first plate 561 relative to second plate 563, the rate of alignment and non-alignment of the plurality of opening in these respective plates may be controlled, and thus generate a corresponding set of pulses in pressure drop and/or fluid flow through the siren, which in turn can be detected and interpreted as data as described throughout this disclosure, and/or via any equivalents thereof. For example, by varying the rate of rotation of the first plate 561 of siren 560 between a first rate of rotation and a second rate of rotation at different time periods, two different frequencies of pressure changes and/or changes in fluid flows can be generated in a manner similar to that described above with respect to graph 530 and FIG. 5B.

The shape, positioning, and total number of openings illustrated in FIGS. 5C and 5D for first plate 561 ad second plate 563 are intended to be non-limiting examples. The shapes, relative positioning, and the total number of openings provided in the first plate 561 and the second plate 563 may be varied while still being used to facilitate the features and the functionality as described with respect to siren 560. In various examples, the number, shape, and/or layout of opening(s) provided in first plate 561 may be different from the number, shape and/or the layout of the openings provided in second plate 563.

In various embodiments, siren includes a sensor 570 configured to detect the rotation of one or both of first plate 561 and/or second plate 563. Sensor 570 is not limited to any particular type of sensor, and may be any type of sensor, such as a Hall effect sensor, optical sensor configured to detect rotation of one or both the plates included in siren 560. Sensor 570 may be configured to provide an output signal, such as an electrical signal, to a controller or other sensor interface through a connection, such as cable 571, wherein the output signal is indicative of the rate or lack thereof of rotation of one or more of the plates included in siren 560. The output signal may be used as feedback information to confirm the proper operation of the siren.

Figure 6A:
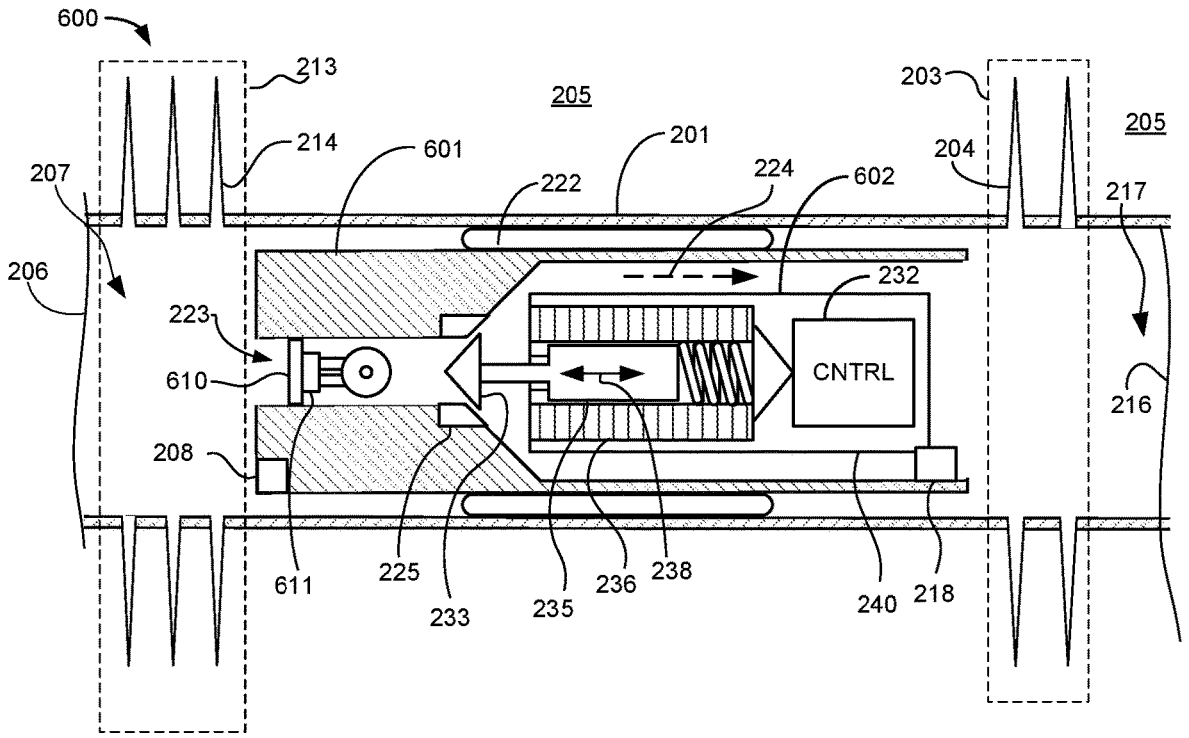
FIG. 6A illustrates a side view of a fluid vortex incorporated into a fluid signal generator according to various embodiments.

FIG. 6A is a cross-sectional diagram illustrating a wellbore system 600 including a plug apparatus (plug) 601 comprising a fluid signal generator assembly 602 deployed within a wellbore, in accordance with various embodiments. In various embodiments, plug 601 includes all or similar features as illustrated and described above with respect to FIG. 2 and plug 220, with the variations as further described below. For the sake of clarity, not every feature of plug 220 is labeled in FIG. 6A with respect to plug 601, but may be present in the various embodiments of plug 601. As illustrated in FIG. 6A, plug 601 is positioned within casing 201 between first fracturing zone 2032 and second fracturing zone 213. Sealing member 222 is configured to seal the outside surface(s) of the housing plug 601 to the inner surface(s) of the casing 201 so that any fluids present in space 207 are sealed off from space 217, and are therefore prevented from passing around the outside surfaces of the plug 601 once plug 601 is positioned at the desired location within the casing 201 and sealing member 222 is activated to be in the sealing configuration In various embodiments, plug 601 includes a fluid signal generator assembly (assembly) 602 that incorporates a controller 232 configured to control stopper 233, connector 234, actuator block 235, and actuator 236 using the configurations as described herein, and any variations thereof. In addition, plug 601 includes a fluid vortex 610. In various emblements, fluid vortex 610 is positioned within the housing opening 223, and is configured to control the flow of fluid through housing opening 223 in order to generate fluid pulse signals in the fluid present in space 207, as further described below. In various embodiments, fluid vortex 610 a fluid diverter 611 configured to shift the flow path of fluid between a first and second flow path, and thus a flow direction, through fluid vortex 610. During the period of time when the fluid diverter 611 is shifting between a first position and a second position, and thus shifting the direction of the flow of fluid through the fluid vortex 610, the fluid of fluid through the fluid vortex may be substantially or completely blocked off or a period of time, thus generating a pulse in the fluid pressure and/or the fluid flow rate through housing opening 223 (assuming stopper 233 is actuated to a position away from housing seat 225 to allow fluid flows out of housing opening 223 and through plug 601 to space 217.

By controlling the operation of fluid diverter 611, and thus the timing of the generation of fluid pluses, controller 232 may generate data in the form of fluid signals in the fluid present in space 207 (for example, as illustrated and described with respect to FIGS. 4A and 4B), wherein the fluid signals may be detected and interpreted by one or more other devices, such as devices located at the surface outside the borehole as described herein, and any equivalents thereof. In embodiments were stopper 233 is provided, stopper 233 may be utilized as a main "ON" and "OFF" seal, wherein when fluid signals are to be generated by the fluid vortex 610, controller 232 activates the assembly 230 to move stopper 233 to a position away from housing seat 225, thus providing an fluid passageway from the housing opening 223 to other passageways extending through plug 601, and sealing housing opening 223 using stopper 233 and housing seat 225 when no fluid signal generation is to be performed. Embodiments of plug apparatus 601 may incorporate a mechanical filter (not specifically shown in FIG. 6A, but the same or similar to filter 209, FIG. 3), such as a sand screen, may be placed over or in the flow path to the housing opening 223 so that the injected proppant would be restricted from entering valve assembly.

Embodiments of fluid diverter 611 may include devices, such as a motor, a solenoid, a ferroelectric actuator, or a pneumatic or hydraulic device configured to change the relative positioning of the fluid diverter 611, and thus generate the fluid pulses in the fluid that may be present in space 207. Power used by fluid diverter 611 may be electrical power, provided for example by a battery (not illustrated in FIG. 6A), and/or by an electrical conductors coupled to an electrical power source (not illustrated in FIG. 6A) that is external to plug 601.

Figure 6B:
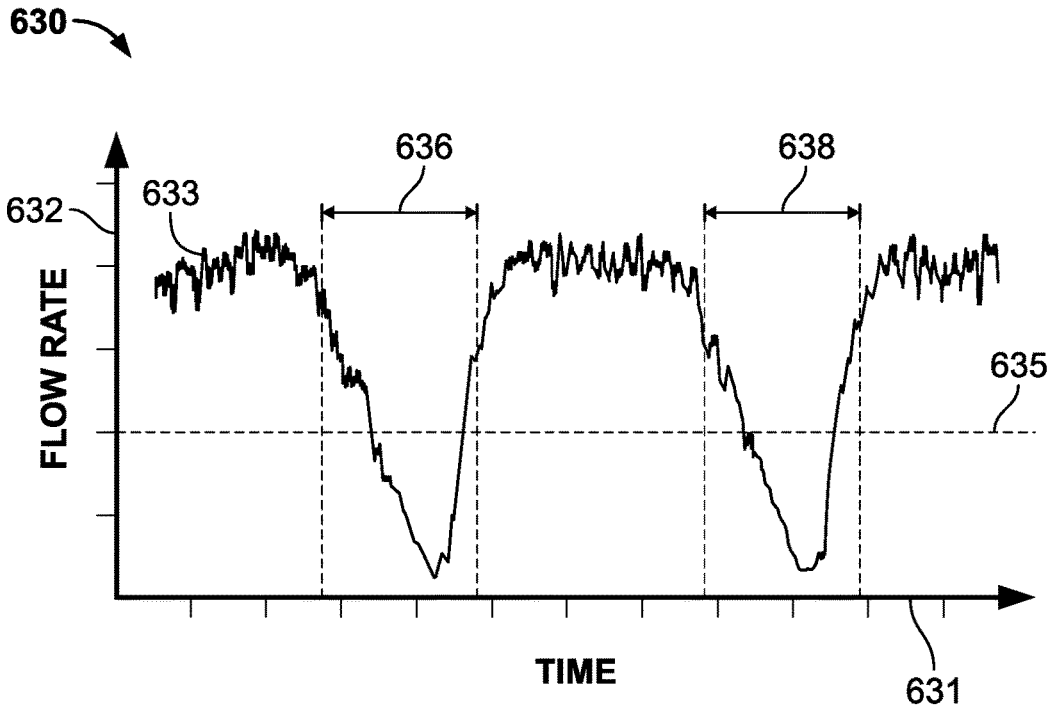
FIG. 6B shows a graph illustrating data generated based on changes in fluid flow rates generated by a fluid signal generator, according to various embodiments.

FIG. 6B shows a graph 630 illustrating data generated based on changes in a flow rate generated by a fluid signal generator, according to various embodiments. In various embodiments, the fluid signal generator is a fluid vortex incorporated into a plug installed in a wellbore for use as part of a fracking process, for example fluid vortex 610 and plug 601 as illustrated and described above with respect to FIG. 6A. Referring back to FIG. 6B, graph 530 includes a horizontal axis 631 representing time, and a vertical axis 632 representing flow rate, such as a fluid flow in a fracturing fluid present within a casing of a borehole that is pressurized against a fracturing plug, such as plug 601 of FIG. 6A. Again referring to FIG. 6B, graphical line 633 represents a flow rate level present within the fracking fluid that varies over time. The variations in the flow rate may include distinct drop in the relative level of the flow rate, wherein the timing of the distinct drops may be interpreted to represent data that is intended to be transmitted through a fluid column to one or more devices outside of the plug generating the fluid pulses represented by graphical line 633. In various embodiments, these drops or dips in the fluid flow rates may be generated by the shifting of the flow diverter operating in conjunction with a fluid vortex device, such a fluid diverter 611 and fluid vortex 610 as illustrated and described above with respect to FIG. 6A.

Referring back to FIG. 6B In various embodiments, when the flow rate represented by graphical line 633 varies over a relatively small range of flow values initially. During the time period represented by time 636, the flow rate drops or dips an amount that is larger, for example by a pre-determined percentage, compared to the relatively small range of variations in flow rates present prior to time period 638. The timing of this drop in flow rate may represent a fluid pulse configured to represent data being imposed onto a fluid column within a wellbore. As illustrated in graph 630, following time period 636, the flow rate of the fluid represented by graphical line 633 returns to a state have a relatively small range of flow values, similar to the at present in the fluid prior to time period 636. Again, at the subsequent time period represented by time period 638, the flow rate of the fluid as represented by graphical line 633 drops or dips by an amount that is larger, for example by a pre-determined percentage, compared to the relatively small range of variations in flow rates present just prior to time period 638. The timing of this drop in flow rate may represent a fluid pulse configured to represent data being imposed onto a fluid column within a wellbore. As illustrated in graph 630, following time period 638, the flow rate of the fluid represented by graphical line 633 returns to a state have a relatively small range of flow values, similar to the at present in the fluid prior to time period 636 and just prior to time period 638. In various embodiments, the dips in fluid flow rates may be detected as a fluid signal pulse when the fluid flow rate drops below a pre-determined flow rate, for example the flow rate indicated by dashed line 635 in graph 630.

As a result of the variations in the timing and/or the frequency of the drops in fluid flow rates, for example as illustratively represented for graphical line 633 during time periods 636 and 638, data representing a series of data bits, including data bits may be imposed onto a fluid present in the wellbore, wherein these variation in the timing and/or frequency of the dips in the flow rate level changes may be transmitted through the fluid to a monitoring device, thus allowing data communications to occur through the fluid, and for example to the surface of a wellbore under the control of a fluid signal generator, such as the siren 525 included as part of plug 520 as illustrated and described in FIG. 5A.

The period of time represented by the time interval between each of time periods 636 and 638 is not limited to a particular time interval, and in various embodiments may be a time interval between 0.01 seconds and 10 minutes, inclusive. The flow rate levels represented by graphical line 633, and the flow rate values assigned to the pre-determined lower flow rate level 635 are not limited to any particular pressure ranges, respectively, and may be determined by such factors as the pressure levels being applied to the fracking fluid proximate to the fluid signal generator present in the wellbore, and the levels of fluid flow variations needed in order to generate data signals that may be detected based on the changes in fluid flows with a minimum level of errors. In various embodiments, a flow rate level for the pre-determined flow rate level 635 may fall within a range of 1 BPM to 20 BPM, inclusive.

Further, the frequencies used to vary the timing of the drops in the flow rates are not limited to any particular frequencies or changes of frequencies, and may include frequencies between 5 hertz and 500 kilohertz, inclusive. The difference between the frequency for a variation in the flow rate level determined to represent a first data value and a frequency for a variation in the flow rate levels determined to represent a second data value is not limited to a particular difference in frequency values, and may be determined in order to minimize the amount of data errors that may occur as a result of the generation and detection of these frequency variations. In various embodiments, the different between these frequencies of pressure level variations may be between 1% and 25% of the highest frequency, inclusive.

It would be understood that instead of detecting variations flow rate levels of the fracking fluid as illustrated in FIG. 6B, the monitoring system used to detect these variations in the fluid pressure levels generated by the fluid vortex could also detect differences in the variations in fluid pressure pulses instead of the variations in flow rates, and thereby communicate that data generated by the siren based on changes in the frequency of the variations of fluid pressure over given time periods.

Figure 6C:
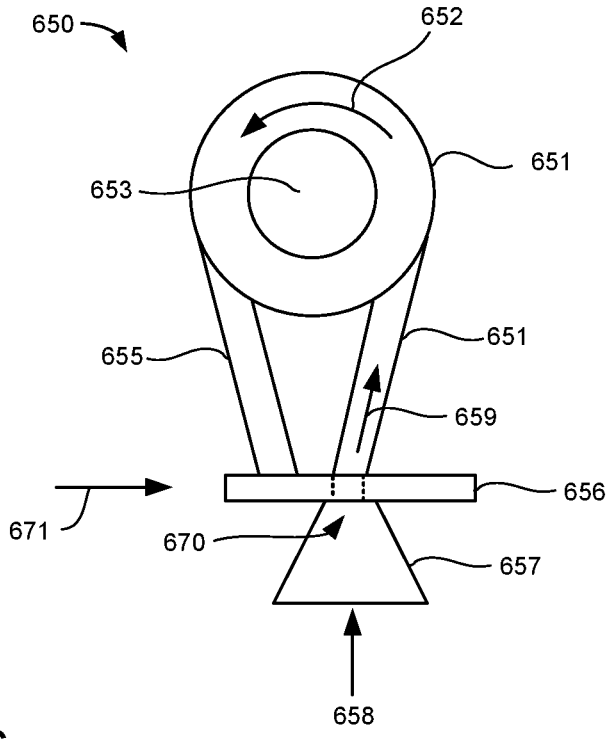
FIGS. 6C and 6D illustrate a cutaway view of a fluid vortex device, according to various embodiments.

FIG. 6C illustrates a side view of a fluid vortex 650 incorporated into a fluid signal generator according to various embodiments. In various embodiments, fluid vortex 650 is incorporated into a fracturing plug installed in a wellbore for use as part of a fracking process, for example as fluid vortex 625 and plug 620 as illustrated and described above with respect to FIG. 6A. As show in FIG. 6A, fluid vortex 650 includes a vortex body 651 coupled to be in fluid communication with a first input leg 654, a second input leg 655, and an exit port 653. A diverter 656 includes a through passageway 670 that is in fluid communication with an input port 657. Diverter 656 is configured to be positioned so that input port 657 and passageway 670 are aligned with the first input leg 654 to allow a flow of fluid entering input port 657 to flow through the diverter and enter the first input leg, while blocking off the entrance to the second input leg 655. Diverter 656 is further configured to be positioned so that input port 657 and passageway 670 are aligned with the second input leg 655 to allow a flow of fluid entering input port 657 to flow through the passageway of the diverter and enter the second input leg, while blocking off the entrance to the first input leg 654.

The vortex body 651 is configured in a circular manner such that any fluid entering into the vortex body from first input leg 654, as indicated by arrow 659, is directed in a generally circular flow around the vortex body, in a direction indicated by arrow 652, before exiting the fluid vortex 650 via exit port 653. Because of the flow path imposed on the fluid(s) entering the vortex body 651 from first input leg 654, a certain level of back pressure is maintained on the fluid, represented by arrow 658, which is entering the fluid vortex 650 through input port 657 and passing through passageway 670 of diverter 656.

Figure 6D:
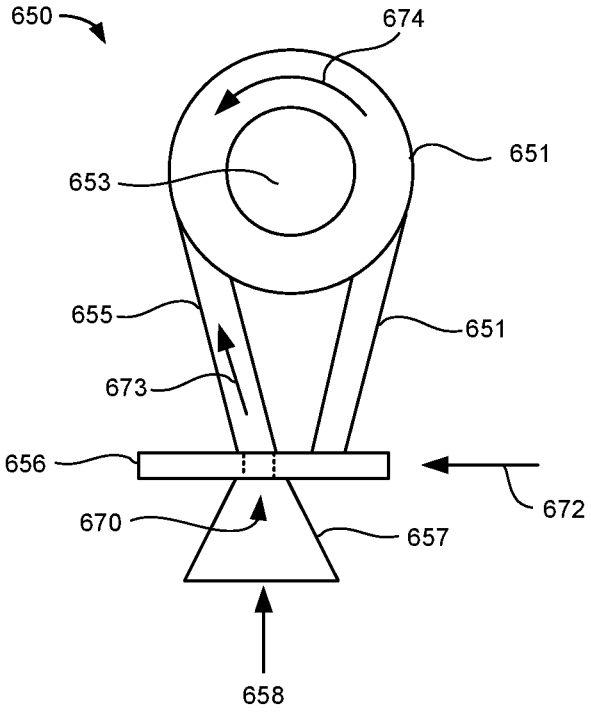

Now referring to FIG. 6D, diverter 656 and input port 657 have been shifted in position, in a direction illustratively represented by arrow 672, so that passageway 670 of the diverted is aligned with the second input leg 655, and the entrance to first input leg 654 is blocked. When configured as illustrated in FIG. 6D, the flow of fluid as represented by arrow 658 into input port 657 is directed into second input leg 655, as generally indicated by arrow 673. The flow of fluid continues through second input leg 655 and into the vortex body 651, creating a flow of fluid within the vortex body generally indicated by arrow 674, before exiting through exit port 653. When in this configuration, diverter 656 also blocks off the entrance to first input leg 654, but preventing the fluid circulating around the vortex body from exiting out through first input leg 654.

During the time of transition of the diverter between the configurations illustrated in FIG. 6C and FIG. 6D, the passageway 670 moves through a position wherein that passageway does not align with either of the inputs to first input leg 654 or second input leg 655. During this transition time, all or most of the fluid flow through passageway 670 is blocked off, creating a pulse in the level of fluid flow passing through the fluid vortex. In addition, a similar condition occurs when the diverter is shifted back from the position shown in FIG. 6D to the configuration shown in FIG. 6C, wherein during the time period when the passageway 670 does not align with either the inputs of the first input leg or the second input leg 655, the flow of fluid into the fluid vortex Amy be completely or nearly completed blocked.

By controlling the timing and or the frequency of these shifts in the position of the diverter back and forth between the configurations shown in FIGS. 6C and 6D, a series of pulses may be generated in the fluid flow entering the fluid vortex that can be interpreted as data.

Figure 7:
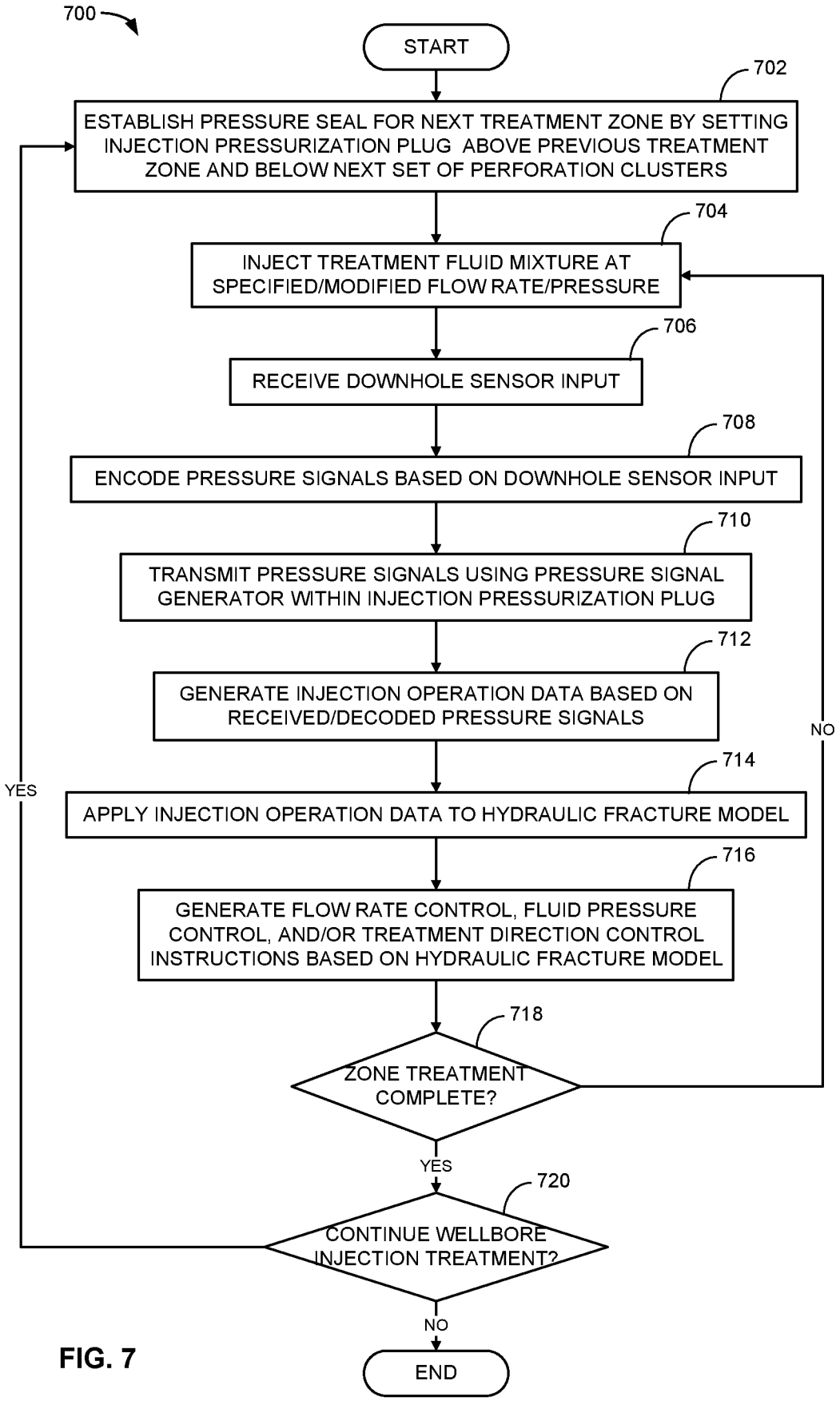
FIG. 7 is a flow chart illustrating a method for providing fluid signal generation as part of a wellbore treatment operation, according to various embodiments.

FIG. 7 is a flow chart illustrating a method 700 for providing fluid signal generation as part of a wellbore treatment operation, according to various embodiments. One or more of the steps included in method 700 may be performed any the devices described throughout this disclosure, including by one or a combination of the devices illustrated and described above with respect to FIG. 1 and system 100. The fluid signal generated used to received sensor signals from one or more sensors positioned downhole and proximate or included as part of the plug apparatus and configured to generate the fluid pulses that are transmitted through the column of fluid present in the wellbore where the plug apparatus is located may be any of the plug apparatus and fluid pulse signal generator devices described throughout this disclosure, and any equivalents thereof.

Referring back to FIG. 7, in various embodiments method 700 includes establishing a pressure seal for a next treatment zone within a wellbore (block 702). Establishing a pressure seal for a next treatment zone may include setting a plug, such as an injection pressurization plug, at a location within the wellbore that is above a previously treated zone within the wellbore. In various embodiments, the location of the plug may be just downhole from a next set of perforation clusters that are to be treated as part of the subsequent wellbore treatment process. The installed plug includes at least one of fluid signal generator or incorporated into the plug and/or otherwise configured to control a flow of fluid provided within the next treatment zone.

In various embodiments, method 700 includes injecting a treatment fluid mixture into borehole (block 704).

In various embodiments, method 700 includes receiving output signals from downhole sensor(s) (block 706).

In various embodiments, method 700 includes processing signals provided by downhole sensor(s) to generate data (block 708).

In various embodiments, method 700 includes transmitting the data using fluid signals generated by a fluid signal generator assembly (block 710).

In various embodiments, method 700 includes detecting fluid signals at one or more uphole devices (block 712). In various embodiments the uphole device(s) includes an acoustic receiver.

In various embodiments, method 700 includes generating injection operation data based on detected fluid signals (block 714).

In various embodiments, method 700 includes apply injection operation data to confirm and/or to generate control modifications related to one or more parameters associated with the injection operation (block 716).

In various embodiments, method 700 includes determining if modifications to the injection process are required, and/or whether to continue the fluid injection treatment being performed on the wellbore (block 720). If "YES", the method includes returning to block 704. If "NO", the method includes determining if the treatment process is complete. If "YES", method 700 includes going to end. If "NO", method 700 includes returning to block 702.

FIG. 8 illustrates a block diagram of an example computer control system 800 that may be employed to practice the concepts, methods, and techniques disclosed herein, and variations thereof. In various embodiments, system 800 includes a plurality of components of the system that are in electrical communication with each other, in some embodiments using a bus 803. System 800 may include any suitable processor 801, along with computer memory 802, and a controller 805. Processor 801 may be configured to perform functions, based on programming and data stored in memory 802, to carry out the methods, and to control apparatus related to the operation of controller 805 in order to perform generation of fluid signals when provided in a plug apparatus positioning in a borehole as described throughout this disclosure, and any equivalents thereof.

In various embodiments, computing system 800 may be a general-purpose computer, and includes a processor 801 (possibly including multiple processors, multiple cores, multiple nodes, and/or implementing multi-threading, etc.). The computer system 800 includes memory 802. The memory 802 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the possible realizations of machine-readable media. The computer system 800 also includes the bus 803 (e.g., PCI, ISA, PCI-Express, HyperTransport® bus, InfiniBand® bus, NuBus, etc.) and a network interface 811 (e.g., a Fiber Channel interface, an Ethernet interface, an internet small computer system interface, SONET interface, wireless interface, etc.). Network interface 811 may be configured to provide a communication link to one or more other computer devices or systems, which for example be me used to download programming memory 802, upload data stored in memory 802, and/or perform any other types of inter-device communication with the device that includes computer system 800. Embodiments of computer system 800 may include an internal power source 804, such as a battery or supercapacitor, which is configured to provide electrical power to operate one or more of the components included in computer system 800, including controller 805 and/or one or more devices coupled to controller 805.

In various embodiments, controller 805 may be configured to receive instructions from processor 801, and based on the received instructions, operate one or more devices configured as actuator 808. For example, controller 805 may be an embodiment of controller 232 (FIG. 2), a controller configured to control the operation of siren 510 or fluid vortex 610, wherein controller 805 is configured to control the operations of the actuator 808 in order to produce fluid signals in a column of fluid as described above, and/or any equivalents thereof. In various embodiments, controller 805 includes a sensor interface 806 coupled to one or more sensors 807. Sensors 807 may be any of sensors located downhole within a borehole, such as sensor 208/218 (FIG. 2), which are configured to provide sensor output signals to sensor interface 806. Sensors 807 may be hardwired to controller 805, and/or may be linked to controller 805 via a wireless connection. Based on the received sensor output signals, controller 805 may, in conjunction with instructions received from processor 801, control the operation of the actuator 808 in order to produce the fluid pule signals that are to be imposed on a column of fluid within a wellbore in order to transmit data to an uphole device, such as a surface device that may include an acoustic receiver.

In various embodiments, actuator 808 may be an electrically and/or electromechanically controlled device, controllable by electrical signal provided by controller 805. In embodiments of a plug apparatus wherein actuator 808 is a pneumatically or hydraulically actuated device, controller 805 may include actuator fluid pump/valving 820, which under the control of controller 805 may be used to provide control over a fluid, such as a pneumatic or hydraulic fluid, to various fluid ports 821 of the actuator 808 in order to control the operation of the actuator. For example, actuator fluid pump/valving 820 may be configured to provide fluid pressures via fluid ports 821 to different sides of an actuator block, such as actuator block 235 (FIG. 2), in order to controllably shift the position of the actuator block and thereby controllably operate a stopper, such as stopper 233 (FIG. 2) in order to produce a desired sequence of fluid pluses to be transmitted through a column of fluid within the wellbore and to another device, such as an uphole monitoring device such as injection rig 130, which may be located at or otherwise above surface of the wellbore.

In various embodiments, computer system 800 may include acoustic receiver/sensor (receiver) 810. Receiver 810 may be configured to sense the fluid signals generated by actuator 808, and provide output signals, such as an electrical output signal, which may be provided to other devices such as processor 801 and/or by controller 805. The received output signals provided by receiver 810 may be used as a feedback signal that may be used to confirm the proper operation of the actuator 808 by confirming that the actual fluid signals imposed on the fluid column and detected by the receiver 810 conform to the intended fluid signals that the processor and the controller 805 are attempting to impose of the fluid column.

FIG. 9 illustrates a block diagram of an example computer system 900 that may be employed to practice the concepts, methods, and techniques disclosed herein, and variations thereof. Embodiments of computer system 900 may represent a computer system located at or incorporated into one or more components of a well system, such as well system 100, including being provided as part of injection rig 130, monitoring/control system 140, injection system 150, and/or user interface computer 170 as illustrated and described above with respect to FIG. 1. Referring back to FIG. 9, computer system 900 may include a combination of, or all of the components illustrated in FIG. 9, including processor 901, memory 902, controller 905, sensors 907, actuators 908, acoustic receiver 910, and network interface 911.

Processor 901 is not limited to any particular type of processor, and may comprise multiple processors as described above with respect to processor 801 (FIG. 8). Memory 902 is not limited to any particular type of computer memory, and may comprise one or more different types of computer memory devices, such as any of the memory devices described above with respect to memory 802. Referring again to FIG. 9, controller 905 is not limited to any particular type of controller or control devices, and may comprise any type of control devices, such as motors, pumps, controllable valves, which are configured to provide any other functions and to provide any of the features needed to operate the well system as described herein, and any equivalents thereof. Controller 905 may be coupled to receive output signals from one or more sensors 907. Sensors 907 are not limed to any particular type of sensors, and may include any type of sensors needed to monitory the operation of the well system. For example, sensor 907 may include sensors configured to sense fluid pressure, temperatures, and/or flow rated related to fluid being utilized as part of a fluid treatment procedure to be or being performed on a wellbore. In addition, controller 905 may be coupled to one or more actuators 908, and configured to control the operation of the one or more actuators in order to perform any of the functions associated the generation of fluid pulse signals to be transmitted uphole through a column of fluid provided to the wellbore as part of a fluid treatment procedure, such as a fracturing procedure.

Embodiments of computer system 900 may include acoustic receiver/sensor (receiver 910). Receiver 910 may be located as an uphole device, such as injection rig 130 (FIG. 1), and configured to detect fluid signal present in a fluid column present in a wellbore, and to produce and output signal, such as an electrical signal, the corresponds to the detected fluid signals. The output signal provided by receiver 910 may be utilized by other devices, such as processor 901, as a source of data transmitted via the fluid signal from a downhole device, such as a plug apparatus, and utilized to record, monitor, and/or to make adjustments to a fluid treatment process that is being performed on the wellbore being monitored by receiver 910.

In various embodiments, computer system 900 includes a network interface 911 configured to allow computer system 900 to communicate with other devices, such as other devices that include additional computer systems. In various embodiments, computer system 900 include an image processor 913. Image processor in various embodiments is configured to process data that is available within the system, including data transmitted from a downhole device such as a plug apparatus to a device at the surface of the wellbore, and to generate image data that can then be used to provide visual displays, such as graphical displays at a computer monitor, based on the processed data and/or other information available to the system.

In various embodiments, computer system 900 includes a plurality of components of the system that are in electrical communication with each other, in some embodiments using a bus 903.

It will be understood that one or more blocks of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus. As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computing system or as a general purpose computer, some embodiments can be any type of device or apparatus to perform operations described herein.

While the aspects of the disclosure are described with reference to various implementations and exploitations, it will be understood that these aspects are illustrative and that the scope of the claims is not limited to them. In general, techniques for implementing formation testing as described herein may be performed with facilities consistent with any system or systems. Plural instances may be provided for components, operations or structures described herein as a single instance. Finally, boundaries between various components, operations and data stores are somewhat arbitrary, and operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components.

Use of the phrase "at least one of" preceding a list with the conjunction "and" should not be treated as an exclusive list and should not be construed as a list of categories with one item from each category, unless specifically stated otherwise.

Example embodiments are provided as follows:

Embodiment 1. An apparatus comprising: a plug apparatus positionable within a wellbore and configured to form a fluid seal between a first section of the wellbore and a second section of the wellbore, the second section of the wellbore located downhole from the first section of the wellbore, the fluid seal configured to provide a seal against a fluid pressure applied to the first section of the wellbore while isolating the second section of the wellbore from the fluid pressure; and a fluid pulse generator configured to controllably allow and block a flow of a fluid through or around the plug apparatus to thereby generate a fluid pulse signal in a column of the fluid that is injected into the first section of the wellbore as part of a stimulation procedure being performed on the wellbore.

Embodiment 2. The apparatus of embodiment 1, wherein the plug apparatus further comprises: a sealing member configured to seal an outside surface of the plug apparatus to an inner surface of a casing of the wellbore so that the fluid that is injected into the first section of the wellbore is prevented from passing around the outside surface of the plug apparatus once the plug apparatus is positioned at a desired location within the casing and the sealing member is activated to be in a sealing configuration.

Embodiment 3. The apparatus of embodiments 1 or 2, wherein the fluid pulse generator comprises: a stopper coupled to an actuator; the actuator configured to move the stopper between a first stopper position and a second stopper position, wherein when in the first stopper position the stopper blocks any fluid communication between the first section of the wellbore and the second section of the wellbore through one or more fluid passageways provided within the plug apparatus, and when in the second stopper position the stopper provides fluid communication between the first section of the well bore and the second section of the wellbore through the one or more fluid passageways provided within the plug apparatus.

Embodiment 4. The apparatus of embodiments 1 or 2, wherein the fluid pulse generator comprises: a siren positioned within the plug apparatus, the siren configured to provide one or more first siren positions that block any fluid communication between the first section of the wellbore and the second section of the wellbore through one or more fluid passageways provided within the plug apparatus, the siren further configured to provide one or more second siren positions that provide fluid communication between the first section of the wellbore and the second section of the wellbore through the one or more fluid passageways provided within the plug apparatus.

Embodiment 5. The apparatus of embodiment 4, wherein the siren further comprises: a first plate having one or more first plate fluid passageways extending through the first plate, and a second plate having one or more second plate fluid passageway extending through the second plate; and an actuator coupled to one or both of the first plate and the second plate, the actuator configured to position the first plate relative to the second plate so that no portion of the one or more first plate fluid passageways align with any portion of the one or more second plate fluid passageways when the siren is in the first siren position, and to position the first plate relative to the second plate so that at least some portion of the one or more first plate fluid passageways align at least one of the one or more second plate fluid passageways when the siren is in the second siren position.

Embodiment 6. The apparatus of any one of embodiments 1-5, wherein the fluid pulse generator is positioned within a portion of a wellbore casing extending between the first section of the wellbore and the second section of the wellbore and adjacent to the plug apparatus, the fluid pulse generator in fluid communication with one or more fluid passageways extending between the first section of the wellbore and the second section of the wellbore and around the plug apparatus, and wherein the fluid pulse generator is configured to controllably allow and block a flow of a fluid through the one or more fluid passageways and around the plug apparatus to thereby generate a fluid pulse signal in a column of the fluid that is injected into the first section of the wellbore.

Embodiment 7. The apparatus of any one of embodiments 1-2 and 6, wherein the fluid pulse generator comprises a fluid vortex coupled to a fluid diverter, the fluid diverter configured to shift a flow path of the fluid present in the first section of the wellbore between a first and second flow path extending through the fluid vortex in order to generate the fluid pulse signal in the column of the fluid that is injected into the first section of the wellbore.

Embodiment 8. The apparatus of any one of embodiments 1-5 and 7, wherein the fluid pulse generator is included in the plug apparatus configured to be pumped or dropped downhole into the wellbore in an orientation so that a sealing surface of the plug apparatus is orientated downhole relative to a front face of the plug apparatus and configured to be brought into physical contact with a sealing surface of a seat positioned within and attached to a casing of the wellbore in order to form the fluid seal between a first section of the wellbore and a second section of the wellbore.

Embodiment 9. The apparatus of any one of embodiments 1-8, wherein a column of the fluid injected into the first section of the wellbore as part of the stimulation procedure has a turbidity measurement of less than 1000 Formazin Nephelometric Units (FNU).

Embodiment 10. The apparatus of any one of embodiments 1-9, wherein the column of the fluid injected into the first section of the wellbore as part of the stimulation procedure being performed on the wellbore includes a fluid pressure in a range from 1,000 to 15,000 pounds per square inch.

Embodiment 11. The apparatus of any one of embodiments 1-10, wherein the fluid pulse signal comprises sensor data gathered at or near the plug apparatus while the plug apparatus is located within the wellbore and while during the stimulation procedure being performed on the wellbore.

Embodiment 12. A method comprising: injecting a treatment fluid into wellbore as part of a stimulation procedure being performed on the wellbore, the wellbore comprising a plug apparatus positioned within the wellbore, the plug apparatus forming a fluid seal between a first section of the wellbore and a second section of the wellbore, the second section of the wellbore located downhole from the first section of the wellbore, the fluid seal providing the fluid seal against a fluid pressure applied by the treatment fluid to the first section of the wellbore while isolating the second section of the wellbore from the fluid pressure; receiving, at a plug apparatus controller, one or more output signals from one or more downhole sensor located within the wellbore and positioned proximate to the plug apparatus; processing, using the plug apparatus controller, the one or more output signals to produce data; and actuating, using the plug apparatus controller, a fluid signal generator to produce a fluid pule signal in the treatment fluid, the fluid pulse signal including data produced based on the output signals.

Embodiment 13. The method of embodiment 12, wherein actuating the fluid signal generator comprises alternatively allowing and blocking a flow of the treatment fluid through or around the plug apparatus between the first section of the wellbore and the second section of the wellbore to generate a sequence of fluid pulses in a column of the treatment fluid present in the first section of the wellbore.

Embodiment 14. The method of embodiments 12 or 13, further comprising: detecting, at an acoustic receiver, the fluid pulse signal transmitted uphole to the acoustic receiver through a column of the treatment fluid present in first section of the wellbore; generating, using the acoustic receiver, and output signal corresponding to the fluid pulse signal detected by the acoustic receiver; and generating injection operation data based on output signal corresponding to the detected fluid pulse signal.

Embodiment 15. The method of embodiment 14, further comprising: performing one or more adjustments to the stimulation procedure being performed on the wellbore based at least in part on the injection operation data.

Embodiment 16. The method of any one of embodiments 12-15, wherein actuating the fluid signal generator to produce the fluid pulse signal in the treatment fluid comprises actuating a siren at a first frequency of operation to generate a first set of fluid pulses corresponding to a first data value and operation the siren at a second frequency of operation to generate a second set of fluid pulses corresponding to a second data value different from the first data value.

Embodiment 17. A system comprising: a plug apparatus positionable within a wellbore and configured to form a fluid seal between a first section of the wellbore and a second section of the wellbore, the second section of the wellbore located downhole from the first section of the wellbore, the fluid seal configured to provide the fluid seal against a fluid pressure applied to the first section of the wellbore while isolating the second section of the wellbore from the fluid pressure; a fluid pulse generator configured to controllably allow and block a flow of a fluid through or around the plug apparatus to thereby generate a fluid pulse signal in a column of the fluid that is injected into the first section of the wellbore as part of the stimulation procedure being performed on the wellbore; and a receiver positioned uphole from the fluid pulse generator, the receiver configured to detect the fluid pulse signal that has been transmitted through the column of the fluid that is injected into the first section of the wellbore, and to generate an output signal based in the detected fluid pulse signal.

Embodiment 18. The system of embodiment 17, wherein the plug apparatus comprises on or more sensor located proximate to or within the plug apparatus, the one or more sensors configured to measure one or more parameters associated with the fluid present in the wellbore, and to provide sensor output signals corresponding to the measured one or more parameters, wherein the fluid pulse generator is configured to generate the fluid pulse signal to include data based at least in part on the sensor output signals.

Embodiment 19. The system of embodiments 17 or 18, further comprising: a monitoring/control system configured to receive the output signal generated by the receiver, and to process the output signal to generate one or more control signals configured to provide control inputs to the stimulation procedure being performed on the wellbore.

Embodiment 20. The system of any one of embodiments 17-19, further comprising: an injection system comprising an injection controller coupled to control a mixing and pumping unit based at least in part on data provided by the fluid pulse signal, the mixing and pumping unit configured to provide the fluid that is injected into the first section of the wellbore as part of the stimulation procedure being performed on the wellbore.

What is claimed is:

1. An apparatus comprising:

a plug apparatus positionable within a wellbore, the plug apparatus including a seat and a first fluid passageway extending through the seat, the seat configured to receive a drop device configured to form a fluid seal with the seat and thereby form a wellbore fluid seal between a first section of the wellbore positioned uphole from the plug apparatus and a second section of the wellbore positioned downhole of the plug apparatus when the drop device has been received at the seat, the first fluid passageway configured to allow a fluid applied at a fluid pressure to the first section of the wellbore to pass through the first fluid passageway and be communicated to the second section of the wellbore when the drop device is not received at the seat, and wherein the seat and the drop device are configured to seal against the fluid pressure applied to the first section of the wellbore while isolating the second section of the wellbore from the fluid pressure when the drop device has been received at the seat; and a fluid pulse generator positioned in a second fluid passageway extending within and through the plug apparatus, the second fluid passageway extending around the seat of the plug apparatus, wherein the fluid pulse generator is configured to controllably allow and block a flow of the fluid through the second fluid passageway to thereby generate a fluid pulse signal in a column of the fluid that is injected into the first section of the wellbore as part of a stimulation procedure being performed on the first section of the wellbore following sealing of the first fluid passageway through the plug apparatus using the drop device and the seat, wherein the first section of the wellbore includes a first set of perforation clusters providing fluid communication between the column of fluid that is injected into the first section of the wellbore and a formation material that is proximate the first set of perforation clusters, and wherein the second section of the wellbore includes a second set of perforation clusters providing fluid communication between the column of fluid injected into the first section of the wellbore and passing through the first passage of the plug apparatus prior to the drop device being received at the seat of the plug apparatus.

2. The apparatus of claim 1, wherein the plug apparatus further comprises:

a sealing member configured to seal an outside surface of the plug apparatus to an inner surface of a casing of the wellbore so that the fluid that is injected into the first section of the wellbore is prevented from passing around the outside surface of the plug apparatus once the plug apparatus is positioned at a desired location within the casing and the sealing member is activated to be in a sealing configuration.

3. The apparatus of claim 1, wherein the fluid pulse generator comprises:

a stopper coupled to an actuator; the actuator configured to move the stopper between a first stopper position and a second stopper position, wherein when in the first stopper position the stopper blocks any fluid communication between the first section of the wellbore and the second section of the wellbore through the second fluid passageway provided within the plug apparatus, and when in the second stopper position the stopper provides fluid communication between the first section of the well bore and the second section of the wellbore through the second fluid passageway.

4. The apparatus of claim 1, wherein the fluid pulse generator comprises:

a siren positioned within the plug apparatus, the siren configured to provide one or more first siren positions that block any fluid communication between the first section of the wellbore and the second section of the wellbore through the second fluid passageway provided within the plug apparatus, the siren further configured to provide one or more second siren positions that provide fluid communication between the first section of the wellbore and the second section of the wellbore through the second fluid passageway.

5. The apparatus of claim 4, wherein the siren further comprises:

a first plate having one or more first plate fluid passageways extending through the first plate, and a second plate having one or more second plate fluid passageway extending through the second plate; and an actuator coupled to one or both of the first plate and the second plate, the actuator configured to position the first plate relative to the second plate so that no portion of the one or more first plate fluid passageways align with any portion of the one or more second plate fluid passageways when the siren is in the first siren position, and to position the first plate relative to the second plate so that at least some portion of the one or more first plate fluid passageways align at least one of the one or more second plate fluid passageways when the siren is in the second siren position.

6. The apparatus of claim 1, wherein the fluid pulse generator comprises a fluid vortex coupled to a fluid diverter, the fluid diverter configured to shift a flow path of the fluid present in the first section of the wellbore between a first and second flow path extending through the fluid vortex in order to generate the fluid pulse signal in the column of the fluid that is injected into the first section of the wellbore.

7. The apparatus of claim 1, wherein the column of the fluid injected into the first section of the wellbore as part of the stimulation procedure has a turbidity measurement of less than 1000 Formazin Nephelometric Units (FNU).

8. The apparatus of claim 1, wherein the column of the fluid injected into the first section of the wellbore as part of the stimulation procedure being performed on the wellbore includes a fluid pressure in a range from 1,000 to 15,000 pounds per square inch.

9. The apparatus of claim 1, wherein the fluid pulse signal comprises sensor data gathered at or near the plug apparatus while the plug apparatus is located within the wellbore and while during the stimulation procedure being performed on the wellbore.

10. The apparatus of claim 1, wherein the plug apparatus includes a receiver configured to receive fluid signals generated by one or more additional downhole plug apparatus, and wherein the fluid pulse generator is configured to generate fluid signals that are induced into the column of the fluid based at least in part on the fluid signals generated by the one or more additional downhole plug apparatus.

11. A method comprising:

injecting a treatment fluid into a wellbore as part of a stimulation procedure being performed on the wellbore, the wellbore comprising a plug apparatus positioned within the wellbore, the plug apparatus including a seat and a first fluid passageway extending through the seat, the seat having received a drop device forming a fluid seal with the seat and thereby forming a wellbore fluid seal between a first section of the wellbore positioned uphole from the plug apparatus and a second section of the wellbore positioned downhole from the plug apparatus, the wellbore fluid seal providing the fluid seal against a fluid pressure applied by the treatment fluid to the first section of the wellbore while isolating the second section of the wellbore from the fluid pressure, wherein the first section of the wellbore includes a first set of perforation clusters providing fluid communication between the fluid pressure applied by the treatment fluid to the first section of the wellbore and a formation material that is proximate the perforation clusters, and wherein the second section of the wellbore includes a second set of perforation clusters providing fluid communication between a column of the treatment fluid injected into the first section of the wellbore and passing through the first passage of the plug apparatus prior to the drop device being received at the seat of the plug apparatus;

receiving, at a plug apparatus controller, one or more output signals from one or more downhole sensor located within the wellbore and positioned proximate to the plug apparatus;

processing, using the plug apparatus controller, the one or more output signals to produce data; and actuating, using the plug apparatus controller, a fluid signal generator to produce a fluid pulse signal in the treatment fluid, the fluid pulse signal including data produced based on the output signals, wherein the fluid signal generator is positioned in a second fluid passageway extending within and through the plug apparatus, the second fluid passageway extending around the seat of the plug apparatus.

12. The method of claim 11, wherein actuating the fluid signal generator comprises alternatively allowing and blocking a flow of the treatment fluid through the second fluid passageway between the first section of the wellbore and the second section of the wellbore to generate a sequence of fluid pulses in the column of the treatment fluid present in the first section of the wellbore.

13. The method of claim 11, further comprising:

detecting, at an acoustic receiver, the fluid pulse signal transmitted uphole to the acoustic receiver through the column of the treatment fluid present in first section of the wellbore;

generating, using the acoustic receiver, and output signal corresponding to the fluid pulse signal detected by the acoustic receiver; and generating injection operation data based on output signal corresponding to the detected fluid pulse signal.

14. The method of claim 13, further comprising:

performing one or more adjustments to the stimulation procedure being performed on the wellbore based at least in part on the injection operation data.

15. The method of claim 11, wherein actuating the fluid signal generator to produce the fluid pulse signal in the treatment fluid comprises actuating a siren at a first frequency of operation to generate a first set of fluid pulses corresponding to a first data value and actuating the siren at a second frequency of operation to generate a second set of fluid pulses corresponding to a second data value different from the first data value.

16. A system comprising:

a plug apparatus positionable within a wellbore, the plug apparatus including a seat and a first fluid passageway extending though the seat, the seat configured to receive a drop device configured to form a fluid seal with the seat and thereby form a wellbore fluid seal between a first section of the wellbore positioned uphole from the plug apparatus and a second section of the wellbore positioned downhole of the plug apparatus when the drop device has been received at the seat, the first fluid passageway configured to allow a fluid applied at a fluid pressure to the first section of the wellbore to pass through the first fluid passageway and be communicated to the second section of the wellbore when the drop device is not received at the seat, and wherein the seat and the drop device are configured to provide the wellbore fluid seal against a fluid pressure applied to the first section of the wellbore while isolating the second section of the wellbore from the fluid pressure when the drop device has been received at the seat;

a fluid pulse generator positioned in a second fluid passageway extending within and through the plug apparatus, the second fluid passageway extending around the seat of the plug apparatus, wherein the fluid pulse generator is configured to controllably allow and block a flow of the fluid through the second fluid passageway to thereby generate a fluid pulse signal in a column of the fluid that is injected into the first section of the wellbore as part of a stimulation procedure being performed on the first section of wellbore following sealing of the first fluid passageway through the plug apparatus using the drop device and the seat, wherein the first section of the wellbore includes a first set of perforation clusters providing fluid communication between the column of fluid that is injected into the first section of the wellbore and a formation material that is proximate the first set of perforation clusters, and wherein the second section of the wellbore includes a second set of perforation clusters providing fluid communication between the column of fluid injected into the first section of the wellbore and passing through the first passage of the plug apparatus prior to the drop device being received at the seat of the plug apparatus; and a receiver positioned uphole from the fluid pulse generator, the receiver configured to detect the fluid pulse signal that has been transmitted through the column of the fluid that is injected into the first section of the wellbore, and to generate an output signal based in the detected fluid pulse signal.

17. The system of claim 16, wherein the plug apparatus comprises on or more sensor located proximate to or within the plug apparatus, the one or more sensors configured to measure one or more parameters associated with the fluid present in the wellbore, and to provide sensor output signals corresponding to the measured one or more parameters, wherein the fluid pulse generator is configured to generate the fluid pulse signal to include data based at least in part on the sensor output signals.

18. The system of claim 16, further comprising:

a monitoring/control system configured to receive the output signal generated by the receiver, and to process the output signal to generate one or more control signals configured to provide control inputs to the stimulation procedure being performed on the wellbore.

19. The system of claim 16, further comprising:

an injection system comprising an injection controller coupled to and configured to control a mixing and pumping unit based at least in part on data provided by the fluid pulse signal, the mixing and pumping unit configured to provide the fluid that is injected into the first section of the wellbore as part of the stimulation procedure being performed on the wellbore.

20. The system of claim 16, wherein the plug apparatus includes a receiver configured to receive fluid signals generated by one or more additional downhole plug apparatus, and wherein the fluid pulse generator is configured to generate fluid signals that are induced into the column of the fluid based at least in part on the fluid signals generated by the one or more additional downhole plug apparatus.

* * * * *